US009423712B2

(12) United States Patent
Sugama et al.

(10) Patent No.: US 9,423,712 B2
(45) Date of Patent: Aug. 23, 2016

(54) TONER FOR ELECTROSTATIC IMAGE DEVELOPMENT

(71) Applicant: Konica Minolta, Inc., Tokyo (JP)

(72) Inventors: Kouji Sugama, Musashino (JP); Hiroshi Nagasawa, Hachioji (JP); Anju Hori, Hachioji (JP); Junya Onishi, Hachioji (JP); Noboru Ueda, Mitaka (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/616,185

(22) Filed: Feb. 6, 2015

(65) Prior Publication Data

US 2015/0227069 A1 Aug. 13, 2015

(30) Foreign Application Priority Data

Feb. 13, 2014 (JP) ..... 2014-025187

(51) Int. Cl.
*G03G 9/087* (2006.01)
*G03G 9/08* (2006.01)

(52) U.S. Cl.
CPC ..... *G03G 9/08733* (2013.01); *G03G 9/0804* (2013.01); *G03G 9/0819* (2013.01); *G03G 9/0825* (2013.01); *G03G 9/08711* (2013.01); *G03G 9/08755* (2013.01); *G03G 9/08782* (2013.01); *G03G 9/08795* (2013.01); *G03G 9/08797* (2013.01)

(58) Field of Classification Search
CPC ..... G03G 9/08724; G03G 9/08755
See application file for complete search history.

(56) References Cited

U.S. PATENT DOCUMENTS

2009/0226834 A1 9/2009 Matsumura
2011/0033795 A1 2/2011 Kouyama et al.

(Continued)

FOREIGN PATENT DOCUMENTS

JP 2005-338548 A 12/2005
JP 2009244857 A 10/2009
JP 2010-191343 A 9/2010
JP 2011145321 A 7/2011
JP 2011257526 A 12/2011

(Continued)

OTHER PUBLICATIONS

Notification of Reasons for Refusal: Patent Application No. 2014-025187; Date of Drafting: Jan. 25, 2016; Representative/Applicant: OI, Masahiko; Applied Provisions: Article 29(1),Article 29(2); total of 5 pages; English translation of Notification of Reasons for Refusal; total of 5 pages; Grand Total of 10 pages.

*Primary Examiner* — Hoa V Le
(74) *Attorney, Agent, or Firm* — Lucas & Mercanti, LLP

(57) ABSTRACT

Disclosed is a toner for electrostatic image development having excellent low-temperature fixability and high-temperature off-set resistance, attaining good image density, and having excellent homogeneity in image density. The toner comprises toner particles containing a binder resin which contains an amorphous resin (A) and an amorphous polyester resin (B) different from the resin (A) and a colorant, wherein the toner particles have a domain-matrix structure having the resin (B) as a domain phase dispersed in a matrix phase comprising the resin (A), and in a cross-sectional image of the toner particles, the number average domain diameter of the domain phase of the resin (B) having a domain diameter of 100 nm or more is 100 to 200 nm and an area ratio of the domain phase having a domain diameter of 500 nm or more relative to the total area of the domain phase is 0 to 10%.

20 Claims, 1 Drawing Sheet

(56) References Cited

U.S. PATENT DOCUMENTS

| | | | | |
|---|---|---|---|---|
| 2012/0264045 | A1* | 10/2012 | Matsushima ..... | G03G 15/1625 430/109.3 |
| 2013/0202997 | A1 | 8/2013 | Iwagoe et al. | |

FOREIGN PATENT DOCUMENTS

| | | | |
|---|---|---|---|
| JP | 2012133136 | A | 7/2012 |
| WO | 2010010889 | A1 | 1/2010 |
| WO | 2012046445 | A1 | 4/2012 |

* cited by examiner

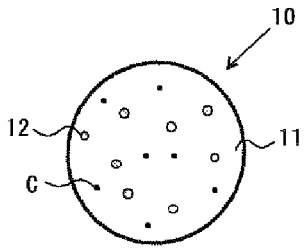
10
12
11
C

TONER FOR ELECTROSTATIC IMAGE DEVELOPMENT

CROSS-REFERENCE TO RELATED APPLICATION

This application is based on Japanese Patent Application No. 2014-025187 filed on Feb. 13, 2014, the contents of which are incorporated herein by reference.

BACKGROUND

1. Technical Field

The present invention relates to a toner for electrostatic image development which is used for in image formation by an electrophotographic system (hereinafter, also simply referred to as a toner).

2. Description of Related Art

Recently, in a production printing field, further increased speed, expanded types of papers and improved image quality of an image forming device such as a copying machine or a printer, have been under progress. As for the toner, it is required to attain further improvement of low-temperature fixability and high-temperature off-set resistance in order to respond to the increased speed and expanded types of papers.

To lower a fixing temperature of a toner, it is necessary to lower a melting temperature or melting viscosity of a binder resin. However, when a glass transition point or a molecular weight of a binder resin is lowered to lower the melting temperature or melting viscosity of binder resin, a new problem such as decreased high-temperature off-set resistance or lowered heat resistant storability of a toner occurs. Under the circumstances, as a technique to have the low-temperature fixability as well as the high-temperature off-set resistance and heat resistant storability, a toner with a core-shell structure having a polyester resin as a shell layer has been proposed (for example, see Japanese Patent Application Laid-Open No. 2005-338548). Specifically, the polyester resin has an advantage in that a low softening point can be easily designed while maintaining a high glass transition point, compared to a styrene-acrylic copolymer resin. Consequently, by using a polyester resin in a shell layer, a toner with excellent high-temperature off-set resistance, heat resistant storability and good low-temperature fixability can be obtained. In particular, for manufacturing a toner by emulsion aggregation process, there is an advantage in that such morphology control can be easily performed.

Meanwhile, in recent years, since types of papers have been further extended, it is required to have fixing on a transfer medium which has been remained difficult to handle like thick paper, an envelope, or a rough paper with high surface irregularity. Under the circumstances, even the toner with a core-shell structure was not found to be sufficient for satisfying the low-temperature fixability and high-temperature off-set resistance.

Furthermore, for satisfying image quality such as high color reproducibility or fine line reproducibility that have been required in the production printing field, it is effective to reduce an amount of toner transferred to a paper. To obtain a suitable image density while reducing an amount of toner transferred to a paper, it is required to fill a large amount of a color material in a toner and dispersing therein homogeneously. In particular, when carbon black generally used as a colorant of a black developer is used, carbon black cannot be satisfactorily dispersed in a resin which is adjusted to have a low molecular weight for low temperature fixing. As a result, problems have been caused that a shielding power is lowered so that sufficient image density is not obtained, and charging property of the toner is impaired so that image defects like uneven image density occur. To solve those problems, a technique of having both high glossiness and high image quality by defining a surface carboxylic acid amount of a resin constituting a toner and using carbon black with pH adjusted to 7 to 10 has been disclosed in Japanese Patent Application Laid-Open No. 2010-191343, for example.

SUMMARY

By the technique disclosed in Japanese Patent Application Laid-Open No. 2010-191343, however, carbon black with pH adjusted to 7 to 10 has a low wetting property, to induce easy aggregation. As such, there is a problem that it is difficult to ensure dispersibility in toner particles.

The present invention is devised in consideration of the circumstances described above, and a purpose of the invention is to provide a toner for electrostatic image development which has excellent low-temperature fixability and high-temperature off-set resistance, attains good image density, and has excellent homogeneity in image density.

To achieve at least one of the above-mentioned objects, a toner for electrostatic image development reflecting one aspect of the present invention comprises toner particles containing a binder resin which contains an amorphous resin (A) and an amorphous polyester resin (B) that is different from the amorphous resin (A) and a colorant, wherein said toner particles have a domain-matrix structure having the amorphous polyester resin (B) as a domain phase dispersed in a matrix phase comprising the amorphous resin (A), and wherein in a cross-sectional observation image of the toner particles, the number average domain diameter of the domain phase of the amorphous polyester resin (B) having a domain diameter of 100 nm or more is 100 to 200 nm and an area ratio of the domain phase having a domain diameter of 500 nm or more relative to the total area of the domain phase is 0 to 10%.

BRIEF DESCRIPTION OF THE DRAWINGS

FIG. 1 is a cross-sectional drawing for illustrating an exemplary cross section of a toner particle which constitutes the toner for electrostatic image development of the present invention. In FIG. 1, the symbol "10" represents a toner particle; "11" represents matrix phase; "12" represents domain phase; and "C" represents domain phase including colorant.

DETAILED DESCRIPTION

The toner for electrostatic image development of the present invention has a feature in comprising toner particles which have a domain-matrix structure having an amorphous polyester resin (B) as a domain phase dispersed in a matrix phase comprising an amorphous resin (A), wherein in a cross-sectional observation image of the toner particles, the number average domain diameter of the domain phase of the amorphous polyester resin (B) having a domain diameter of 100 nm or more is 100 to 200 nm and an area ratio of the domain phase having a domain diameter of 500 nm or more relative to the total area of the domain phase is 0 to 10%. By this, the toner can show excellent low-temperature fixability and high-temperature off-set resistance, give good image density, and excel in homogeneity in image density.

Hereinbelow, the present invention will be described in detail.

[Toner for Electrostatic Image Development]

The toner of the present invention includes toner particles containing at least a binder resin which contains an amorphous resin (A) and an amorphous polyester resin (B) that is different from the amorphous resin (A) and a colorant. The toner particles may also contain a releasing agent, a charge controlling agent, or the like in addition to the binder resin and colorant. Further, an external additive like a fluidizing agent may be also added to the toner particles.

Specifically, for the toner of the present invention, a toner particle 10 has a domain-matrix structure having an amorphous polyester resin (B) dispersed, as a domain phase 12, in a matrix phase 11 including an amorphous resin (A), as illustrated in FIG. 1. The symbol "C" indicates the domain phase including a colorant in FIG. 1.

The toner of the present invention has a feature in that, in a cross-sectional observation image of the toner particles, the number average domain diameter of a domain phase of the amorphous polyester resin (B) having a domain diameter of 100 nm or more is 100 to 200 nm and an area ratio of a domain phase having a domain diameter of 500 nm or more relative to the total area of the domain phase 12 is 0 to 10%.

Although the mechanism for exhibiting the effect or the working mechanism of the present invention is not clear, it is speculated as described below. Meanwhile, the present invention is not limited.

In the toner of the present invention, the toner particle 10 comprises an "amorphous resin (A)" with excellent high-temperature off-set resistance as a matrix phase 11 and an "amorphous polyester resin (B)" with excellent low-temperature fixability as a domain phase 12. The "matrix phase" also functions as a medium (mother body) for incorporating and maintaining the "domain phase" therein. The "domain phase" is present as a separate and independent micro-region in a phase-separated state in the matrix phase without being compatibilized with the matrix phase. Furthermore, by such a domain-matrix structure, properties originated from each resin can be exhibited.

The domain-matrix structure according to the present invention is also referred to as a sea-island structure. As illustrated in FIG. 1, the sea-island structure indicates a structure in which an island-like phase (the domain phase 12) having a closed interface (boundary between phases) is present in a continuous phase of the toner particle 10 (the continuous phase is the matrix phase 11, which represents the sea). Namely, the domain-matrix structure indicates a high-dimensional structure that plural (for example, two types) non-compatibilizing resin components are mixed, one of the resin components in an island-like or a particle-like shape is scattered in a continuous phase (sea) of the other resin component. Namely, it indicates a structure formed by having one resin as a continuous phase (sea) corresponding to the matrix phase and the other resin as an island-like separate phase (dispersed phase) corresponding to the domain phase.

The amorphous resin (A) constituting the matrix phase 11 is a resin showing high elasticity at a high temperature, and therefore it serves to enhance high-temperature off-set resistance. Meanwhile, the amorphous polyester resin (B) constituting the domain phase 12 is a resin having a sharp melting property while maintaining high glass transition point (Tg), and therefore it serves to enhance low-temperature fixability.

Herein, it is believed that, as the amorphous polyester resin (B) is present as the domain phase 12 in the matrix phase 11 and also present near the surface of the toner particle 10, the sharp melting property of the polyester resin can be effectively exhibited. Namely, it is believed that while in the case of toner particles having a core-shell structure, exhibition of core property may be affected by the presence of a shell, in the case of a domain-matrix structure, both the amorphous resin (A) constituting the matrix phase 11 and the amorphous polyester resin (B) constituting the domain phase 12 are present near the surface of the toner particle 10, and thus the property of each resin can be fully exhibited at the time of fixing.

It is also preferable that each of the domain phase 12 including the amorphous polyester resin (B) and a domain phase C including a colorant is independently present in the matrix phase 11.

Furthermore, it is believed that, when the number average domain diameter of the domain phase 12, which includes the amorphous polyester resin (B), is set within the range of 100 to 200 nm and an area ratio of a domain phase having a domain diameter of 500 nm or more relative to the total area of the domain phase 12 is set within the range of 0 to 10%, the domain phase 12 including the amorphous polyester resin (B) or the domain phase C including a colorant can be uniformly dispersed in the matrix phase 11 even when the colorant is filled at a high concentration, and thus good image density can be achieved while exhibiting function of sharp melting property of the amorphous polyester resin (B), and an image with excellent homogeneity in image density can be formed.

Further, when a rough paper with high surface irregularity is used, excessive heat energy is generally supplied to a toner transferred on a convex part in order to fix a toner transferred to a concave part of the paper. As such, high temperature off-set can easily occur at a convex part. However, according to the present invention, the toner particle 10 is prepared to have a domain-matrix structure, and therefore it is possible to have the amorphous resin (A) constituting the matrix phase 11 even on a surface of the toner particle 10. Accordingly, even in the case of using a rough paper with high surface irregularity, it is believed that high elasticity effect by the amorphous resin (A) can fully exhibited even for the toner transferred to a convex part so that the high temperature off-set can be suppressed.

As used herein, the term "rough paper" is referred to as a recording medium which has smoothness of 5 sec or longer but shorter than 10 sec. As used herein, the "smoothness" is Beck smoothness which is described in "JIS-P8119", and the smaller value represents a huskier surface with higher irregularity.

Hereinbelow, the constitution of the toner of the present invention will be described in order.

<<Structure of Toner Particle>>

The toner particle 10 constituting the toner of the present invention comprises the amorphous polyester resin (B) present as the domain phase 12 in the matrix phase 11 formed by the amorphous resin (A), and in a cross-sectional observation image of the toner particles, the number average domain diameter of the domain phase 12 including the amorphous polyester resin (B) having a domain diameter of 100 nm or more is 100 to 200 nm and the area ratio of a domain phase having a domain diameter of 500 nm or more relative to the total area of the domain phase 12 is 0 to 10%.

With regard to the domain phase 12 including the amorphous polyester resin (B) having a domain diameter of 100 nm or more, the number average domain diameter of the domain phase 12 is preferably 100 to 200 nm, and more preferably 100 to 150 nm.

When the number average domain diameter of the domain phase 12 is within the aforementioned range, the total interface area with the amorphous resin (A) can be fallen within a preferred range and each resin property of the amorphous resin (A) constituting the matrix phase 11 and the amorphous polyester resin (B) constituting the domain phase 12 can be effectively exhibited, and thus good low-temperature fixability can be obtained. Furthermore, when the number average domain diameter of the domain phase 12 is within the range, the amount of the amorphous resin (A) near the surface of the toner particle 10 can be controlled to a preferred range, and thus excellent high-temperature off-set resistance can be obtained even when a rough paper with high surface irregularity is used.

With regard to the domain phase including the amorphous polyester resin (B) having a domain diameter of 100 nm or more, the area ratio of a domain phase having a domain diameter of 500 nm or more relative to the total area of the domain phase is 0 to 10%, preferably 0 to 8%, and more preferably 0 to 5%.

When the area ratio of a domain phase having a domain diameter of 500 nm or more is within the range, the domain phase C including a colorant can be homogeneously dispersed in the matrix phase 11, and thus an image with good image density and excellent homogeneity in image density can be formed.

<Method for Measuring Number Average Domain Diameter and Area Ratio of Domain Phase>

With regard to the toner particle 10 according to the present invention, a method for measuring the number average domain diameter of the domain phase 12 having a domain diameter of 100 nm or more and the area ratio of the domain phase 12 having a domain diameter of 500 nm or more relative to the total area of the domain phase 12 having a domain diameter of 100 nm or more will be described hereinbelow.

(1. Observation of Domain-Matrix Structure)

Apparatus for evaluation: Scanning transmission electron microscope "JSM-7401F" (manufactured by JEOL Ltd.)

Sample for evaluation: toner segment stained with $RuO_4$ (segment thickness: 100 to 200 nm)

Acceleration speed: 30 kV

Magnification ratio: ×10000, bright field image (2. Methods for Preparing and Identifying Toner Segment)

[Method for Preparing Toner Segment]

Toner particles are dispersed in a photocurable resin (D-800, manufactured by JEOL Ltd.) followed by photocuring, to form a block. Subsequently, by using a microtome equipped with diamond teeth, a foil-like sample with a thickness of 100 to 200 nm is cut out from the block. It is then applied on a grid with a supporting film which is used for a scanning transmission electron microscope.

A filter paper is applied on a 5 cm ϕ plastic petri dish and the grid with the segment is applied on the filter paper such that the segment side faces upward.

Staining conditions (time, temperature, and concentration and amount of staining agent) are adjusted according to the conditions which allow identification of each resin by observation under a scanning transmission electron microscope. For example, two or three drops of 0.5% $RuO_4$ staining solution are added dropwise on two areas in a petri dish and covered with a lid. Ten minutes later, the cover of a petri dish is removed, and the dish is kept until moisture of the staining solution disappears.

[Method for Identification]

The toner components in the toner particles are identified according to the following criteria.

Dark tone is observed: Amorphous resin

Bright tone is observed: Amorphous polyester resin

Bright tone is observed and also interface is observed with dark tone: Releasing agent (3. Calculation of Number Average Domain Diameter and Area Ratio)

Apparatus for evaluation: Scanning transmission electron microscope (which is the same as the observation of a domain-matrix structure) and image processing and analyzing device "LUZEX (registered trademark) AP" (manufactured by Nireco Corporation).

Conditions for evaluation: The method for obtaining a toner image for measurement is the same as the "Observation of domain-matrix structure".

[Method for Measurement]

With regard to the toner particle image for measurement, 25 or more visual fields of the toner particles in which the cross section diameter of a toner particle equals to the volume average particle diameter ($D_{50}$% diameter) of the toner particle of ±10% are selected and used for the measurements. Among the 25 or more visual fields of the toner particle image, 200 or more domain phases which include the amorphous polyester resin (B) with a domain diameter of 100 nm or more are randomly selected and used for measurement of domain diameter.

The number average domain diameter is calculated as an average value of Feret diameters in a horizontal direction. The domain area is obtained by measuring an actual area of a domain phase with a diameter of 100 nm or more. As used herein, the Feret diameter in a horizontal direction represents a side length of a circumscribed rectangle according to binarization of an image, in which the side indicates a side parallel to X axis.

According to the present invention, it is preferable that the domain phase 12 including the amorphous polyester resin (B), the domain phase C including a colorant, and if necessary, a domain phase including a releasing agent are scattered (present in a dispersed state) in the matrix phase 11 including the amorphous resin (A), in which each of them singly forms a domain phase. When each domain phase is present singly, there may be a contact between domain phases or it may be independently present in a separate state. However, it is preferable that the domains are independently present in a separate state. When each domain phase is independently present in a separate state, each property of the amorphous polyester resin (B) constituting the matrix phase, a colorant, and a releasing agent can be separately exhibited. Meanwhile, as used herein, the description "singly forms a domain phase" is referred to as a state that the amorphous polyester resin (B), a colorant, and a releasing agent do not mingle with one another so that each independently forms a domain phase.

Herein, the number average domain diameter of the domain phase C including a colorant is preferably 10 to 300 nm, and more preferably 10 to 200 nm.

When the number average domain diameter of the domain phase C including a colorant is within the range, a sufficient amount of a colorant can be present in the toner particle 10 with no localization, and thus sufficient image density can be obtained. When the number average domain diameter of the domain phase C including a colorant is less than 10 nm, a shielding power may be lowered so that sufficient image density may not be obtained. On the other hand, when the number average domain diameter of the domain phase C including a colorant is more than 300 nm, the colorant may be localized without being fully dispersed in the toner particle 10 so that sufficient image density may not be obtained.

The number average domain diameter of the domain phase C including a colorant is a value which is measured as follows.

Specifically, toner particles are dispersed in a photocurable resin (D-800, manufactured by JEOL Ltd.) followed by photocuring, to forma block. Subsequently, by using a microtome equipped with diamond teeth, a foil-like sample with a thickness of 100 to 200 nm is cut out from the block to produce a segment. The ultra-thin segment is then photographed with a scanning transmission electron microscope "JSM-7401F" (manufactured by JEOL Ltd.). Specifically, with regard to the "observation of domain-matrix structure", a toner segment from the non-stained toner particles is observed. With regard to the cross-sectional observation image of the toner particles, a domain phase including a colorant, which is observed from 100 toner particles, is randomly selected as a primary particle and the domain diameter is measured. The number average domain diameter is calculated as an average value of Feret diameter in a horizontal direction.

<<Amorphous Resin (A) (Matrix Phase 11)>>

Examples of the amorphous resin (A) constituting the matrix phase 11 include a vinyl resin such as a styrene resin, an acrylic resin, or a styrene-acrylic resin, and an amorphous polyester resin. Among them, from the viewpoint of the high-temperature off-set resistance, a vinyl resin, in particular, a styrene-acrylic resin is preferable.

Examples of a polymerizable monomer for forming a vinyl resin include a monomer having an ethylenically unsaturated bond allowing a radical polymerization, and specific examples thereof include a styrene-based monomer and a (meth)acrylic acid ester monomer, or the like.

Examples of the styrene monomer for forming a vinyl resin include styrene, o-methyl styrene, m-methyl styrene, p-methyl styrene, p-methoxystyrene, p-phenyl styrene, p-chlorostyrene, p-ethyl styrene, p-n-butyl styrene, p-tert-butyl styrene, p-n-hexyl styrene, p-n-octyl styrene, p-n-nonyl styrene, p-n-decyl styrene, p-n-dodecyl styrene, 2,4-dimethyl styrene, 3,4-dichlorostyrene, and their derivatives. It may be used either singly or in combination of two or more members.

Examples of the (meth)acrylic acid ester monomer for forming a vinyl resin include, as an acrylic acid ester monomer, methyl acrylate, ethyl acrylate, butyl acrylate, 2-ethylhexyl acrylate, cyclohexyl acrylate, and phenyl acrylate, and as a methacrylic acid ester monomer, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethylaminoethyl methacrylate, and diethylaminoethyl methacrylate. The (meth)acrylic acid ester monomer may be used either singly or in combination of two or more members.

As a polymerizable monomer for forming a vinyl resin, it is also possible to use a third vinyl monomer. Examples of the third vinyl monomer include an acid monomer such as acrylic acid, methacrylic acid, maleic acid anhydride, and vinyl acetic acid, acrylamide, methacrylamide, acrylonitrile, ethylene, propylene, butylene, vinyl chloride, N-vinylpyrrolidone and butadiene.

As a polymerizable monomer for forming a vinyl resin, a poly-functional vinyl monomer may be used. Examples of the poly-functional vinyl monomer include a diacrylate such as ethylene glycol, propylene glycol, butylene glycol and hexylene glycol, divinylbenzene, and a dimethacrylate and a trimethacrylate of a tertiary or higher alcohol such as pentaerythritol or trimethylol propane. A copolymerization ratio of the poly-functional vinyl-based monomer relative to the entire polymerizable monomer is generally 0.001 to 5% by mass, preferably 0.003 to 2% by mass, and more preferably 0.01 to 1% by mass. By using the poly-functional vinyl-based monomer, a gel component insoluble in tetrahydrofuran is produced, and a ratio of the gel component in the entire polymerization product is generally 40% by mass or less, and preferably 20% by mass or less.

The amorphous polyester resin represents, among the polyester resins that are manufactured by polycondensation reaction in the presence of an appropriate catalyst by using, as raw materials, a polyhydric carboxylic acid (or its derivatives) and a polyhydric alcohol (or its derivatives), those exhibiting no clear endothermic peaks according to differential scanning calorimetry (DSC). The clear endothermic peak specifically means a peak with the half width of 15° C. or lower in an endothermic peak when the measurement according to differential scanning calorimetry (DSC) is made at a temperature increasing rate of 10° C./min.

Examples of the polyhydric carboxylic acid for forming the amorphous polyester resin include saturated aliphatic carboxylic acid such as oxalic acid, malonic acid, succinic acid, glutaric acid, adipic acid, pimelic acid, suberic acid, azelaic acid, sebacic acid, 1,9-nonane dicarboxylic acid, 1,10-decane dicarboxylic acid, 1,11-undecane dicarboxylic acid, 1,12-dodecane dicarboxylic acid, 1,13-tridecane dicarboxylic acid, 1,14-tetradecane dicarboxylic acid, 1,16-hexadecane dicarboxylic acid, and 1,18-octadecane dicarboxylic acid; aromatic dicarboxylic acid such as phthalic acid, isophthalic acid, terephthalic acid, and naphthalene dicarboxylic acid; aliphatic unsaturated dicarboxylic acid such as maleic acid, fumaric acid, itaconic acid, citraconic acid, glutaconic acid, isododecenyl succinic acid, n-dodecenyl succinic acid, and n-octenyl succinic acid; and carboxylic acid with valency of two or higher such as trimellitic acid, pyromellitic acid, naphthalene tricarboxylic acid, naphthalene tetracarboxylic acid, pyrene-tricarboxylic acid, and pyrene-tetracarboxylic acid. An acid anhydride and acid chloride thereof, or the like can be also mentioned.

Examples of the polyhydric alcohol for forming the amorphous polyester resin include aliphatic diols such as ethylene glycol, 1,3-propane diol, 1,4-butane diol, 1,5-pentane diol, 1,6-hexane diol, 1,7-heptane diol, 1,8-octane diol, 1,9-nonane diol, 1,10-decane diol, 1,11-undecane diol, 1,12-dodecane diol, 1,13-tridecane diol, 1,14-tetradecane diol, 1,18-octadecane diol, and 1,20-eicosane diol; bisphenols such as bisphenol A and bisphenol F, and an alkylene oxide adduct of bisphenols such as ethylene oxide adduct and propylene oxide adduct thereof; and polyols with valency of three or higher such as glycerin, pentaerythritol, hexamethylol melamine, hexaethylol melamine, tetramethylol benzoguanamine, or tetraethylol benzoguanamine.

The glass transition point (Tg) of the amorphous resin (A) is preferably 40 to 60° C.

Further, the softening point of the amorphous resin (A) is preferably 80 to 120° C.

When the glass transition point and the softening point of the amorphous resin (A) are within the range, both effects of the high-temperature off-set resistance and fixing separability can be exhibited.

<Method for Measurement of Glass Transition Point (Tg)>

The glass transition point (Tg) of the amorphous resin (A) indicates a value which is measured according to the method defined by Standards according to American Society for Testing and Materials (ASTM) D3418-82 (DSC method).

Specifically, 4.5 mg of a measurement sample (the amorphous resin (A)) is weighed to two decimal places and sealed in an aluminum pan. It is then set in a sample holder of a differential scanning calorimeter "DSC8500" (manufactured by PerkinElmer Co., Ltd.). An empty aluminum pan is used as a reference. The temperature is controlled through heating-cooling-heating at a temperature-increasing rate of 10° C./min and a temperature-lowering rate of 10° C./min at a measurement temperature of −10 to 120° C. The analysis is made based on the data of the second heating. The value obtained from the intersection between an extension line from the base-line prior to the rise of the first endothermic peak and a tangent line exhibiting the maximum slope between the rising of the first endothermic peak and peak is defined as the glass transition point.

<Method for Measurement of Softening Point (Tsp)>

The softening point (Tsp) of the amorphous resin (A) is a value which is measured as described below.

First, in an environment of 20° C.±1° C. and 50%±5% RH, 1.1 g of a measurement sample (the amorphous resin (A)) is added to a petri dish, evenly spread, and kept at least for 12 hours. By using a molding machine "SSP-10A" (manufactured by Shimadzu Corporation), the sample is compressed for 30 seconds with a force of 3820 kg/cm$^2$, to produce a cylindrical molded sample with a diameter of 1 cm. Subsequently, as soon as the pre-heating is completed, the molded sample is extruded through holes (1 mm diameter×1 mm) of a cylindrical die by using a piston with a diameter of 1 cm under conditions including a load of 196 N (20 kgf), an initial temperature of 60° C., pre-heating time of 300 seconds, and a temperature increasing rate of 6° C./minute in an environment of 24° C.±5° C. and 50%±20% RH using "FLOW TESTER CFT-500D" (manufactured by Shimadzu Corporation). The off-set method temperature $T_{offset}$, which is measured with a setting with off-set volume of 5 mm according to a melting temperature measuring method based on a temperature-increasing method, is a softening point of the resin.

It is preferred for the amorphous resin (A) to have a weight average molecular weight of 15,000 to 80,000.

<Method for Measuring Molecular Weight>

The molecular weight of the amorphous resin (A) is a value which is measured by gel permeation chromatography (GPC) as described below.

Specifically, the apparatus "HLC-8120 GPC" (manufactured by TOSOH CORPORATION) and the column "TSK guard column+TSK gel Super HZ-M3 series" (manufactured by TOSOH CORPORATION) are used. Tetrahydrofuran (THF) is added as a carrier solvent at a flow rate of 0.2 ml/min while maintaining the column temperature at 40° C. A measurement sample (the amorphous resin (A)) is dissolved in tetrahydrofuran to have a concentration of 1 mg/ml under dissolving conditions including 5-minute treatment at room temperature with an ultrasonic disperser, and the resultant solution is treated with a membrane filter with a pore size of 0.2 μm, to prepare a sample solution. Subsequently, 10 μL of the sample solution is injected to the device together with the carrier solvent, the detection is made by using a refractive index detector (RI detector), and molecular weight distribution of the measurement sample is calculated by using a calibration curve which is established by using mono-dispersed polystyrene reference particles. Ten points were employed as the polystyrene for establishing a calibration curve.

A content of the amorphous resin (A) constituting the matrix phase 11 is preferably 70 to 95% by mass, and more preferably 80 to 90% by mass, relative to the total amount of the binder resin.

When the content of the amorphous resin (A) is within the range, both the low-temperature fixability and high-temperature off-set resistance can be obtained and the colorant can be homogeneously dispersed. As a result, not only good image density can be obtained but also uniform image density can be ensured.

<Method for Producing Amorphous Resin (A)>

When the amorphous resin (A) is a vinyl resin, production is preferably made by emulsion polymerization. The emulsion polymerization is a method for dispersing a polymerizable monomer like styrene and acrylic acid ester in an aqueous medium for polymerization. For dispersing a polymerizable monomer in an aqueous medium, it is preferable to use a surfactant. Further, a polymerization initiator and a chain transfer agent may be used for the polymerization.

According to the present invention, when the amorphous resin (A) is a vinyl resin, it is preferred not to use a monomer having a linear alkyl group with 6 or more carbon atoms as a polymerizable monomer for forming the vinyl resin, from the viewpoint of suppressing formation of a domain phase with a domain diameter of 500 nm or more, which will be described below.

(Polymerization Initiator)

The polymerization initiator used for polymerization of the amorphous resin (A) is not particularly limited, and well-known ones can be used. Specific examples thereof include peroxides such as hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, ammonium persulfate, sodium persulfate, potassium persulfate, diisopropyl peroxycarbonate, tetralin hydroperoxide, 1-phenyl-2-methylpropyl-1-hydroperoxide, per-triphenylacetic acid-tert-hydroperoxide, tert-butyl performate, tert-butyl peracetate, tert-butyl perbenzoate, tert-butyl perphenylacetic acid, tert-butyl permethoxyacetic acid, or tert-butyl N-(toluoyl)palmitic peracid; and azo compounds such as 2,2'-azobis(2-aminodipropane)hydrochloride, 2,2'-azobis-(2-aminodipropane)nitrate, 1,1'-azobis(sodium 1-methylbutylonitrile-3-sulfonate), 4,4'-azobis-4-cyanovaleric acid, or poly(tetraethylene-glycol-2,2'-azobisisobutylate).

An amount of the polymerization initiator to be added may be varied depending on desired molecular weight or molecular weight distribution. Specifically, it is preferably added within the range of 0.1 to 5% by mass, relative to a polymerizable monomer.

(Chain Transfer Agent)

For polymerization of the amorphous resin (A), a chain transfer agent can be also added together with a polymerizable monomer. By adding a chain transfer agent, molecular weight of the polymer can be controlled. As for the chain transfer agent, generally used chain transfer agents can be used. Examples thereof include alkyl mercaptan and mercapto fatty acid ester, or the like.

An amount of the chain transfer agent to be added may be varied depending on desired molecular weight or molecular weight distribution. Specifically, it is preferably added within the range of 0.1 to 5% by mass, relative to a polymerizable monomer.

(Surfactant)

When the amorphous resin (A) is dispersed in an aqueous medium and subjected to polymerization through emulsion polymerization, a dispersion stabilizer is usually added thereto to prevent aggregation of dispersed liquid droplets. Such a dispersion stabilizer may employ well-known surfactants, and there may be used a dispersion stabilizer chosen from a cationic surfactant, an anionic surfactant, and a nonionic surfactant. Such surfactants may be used in combination of two or more members. Meanwhile, a dispersion stabilizer may be also used in a dispersion of a colorant, an off-set inhibitor or the like.

Specific examples of the cationic surfactant include dodecyl ammonium bromide, dodecytrimethyl ammonium bromide, dodecyl pyridinium chloride, dodecylpyridinium bromide, and hexadecyltrimethyl ammonium bromide.

Specific examples of the nonionic surfactant include polyoxyethylene dodecyl ether, polyoxyethylene hexadecyl ether, polyoxyethylene nonylphenyl ether, polyoxyethylene lauryl ether, polyoxyethylene sorbitan monooleate ether, polyoxyethylene styrylphenyl ether, and monodecanoyl sucrose.

Specific examples of the anionic surfactant include an aliphatic soap such as sodium stearate or sodium laurate, sodium lauryl sulfate, sodium dodecylbenzene sulfonate, and polyoxyethylene (2) lauryl ether sodium sulfate. The surfactant may be used either singly or in combination of two or more members as necessary.

When the amorphous resin (A) is an amorphous polyester resin, a previously known general scheme can be used as a method for producing the amorphous polyester resin.

When the amorphous resin (A) is an amorphous polyester resin in the present invention, it is preferred not to use saturated linear aliphatic dicarboxylic acid with 6 or more carbon atoms as polyhydric carboxylic acid for forming the amorphous polyester resin, from the viewpoint of forming a domain-matrix structure, which will be described below.

<<Amorphous Polyester Resin (B) (Domain Phase 12)>>

The amorphous polyester resin (B) constituting the domain phase 12 means, among the polyester resins that are manufactured by a polycondensation reaction in the presence of an appropriate catalyst by using, as raw materials, a polyhydric carboxylic acid (or its derivatives) and a polyhydric alcohol (or its derivatives), those not exhibiting a clear endothermic peak according to differential scanning calorimetry (DSC). The clear endothermic peak specifically means a peak with the half width of 15° C. or lower in an endothermic peak when the measurement according to differential scanning calorimetry (DSC) is made at a temperature increasing rate of 10° C./min.

With regard to the toner of the present invention, the amorphous polyester resin (B) is preferably a resin (hereinbelow, also referred to as a "composite resin") obtained by chemical binding between a vinyl polymerization segment and a polyester polymerization segment via a monomer capable of reacting with both the segment (hereinbelow, also referred to as a "bireactive monomer"), from the viewpoint of attaining excellent charging property and stable image quality.

Examples of the polyhydric carboxylic acid for forming the amorphous polyester resin (B) include saturated aliphatic carboxylic acid such as oxalic acid, malonic acid, succinic acid, glutaric acid, adipic acid, pimelic acid, suberic acid, azelaic acid, sebacic acid, 1,9-nonane dicarboxylic acid, 1,10-decane dicarboxylic acid, 1,11-undecane dicarboxylic acid, 1,12-dodecane dicarboxylic acid, 1,13-tridecane dicarboxylic acid, 1,14-tetradecane dicarboxylic acid, 1,16-hexadecane dicarboxylic acid, and 1,18-octadecane dicarboxylic acid; aromatic dicarboxylic acid such as phthalic acid, isophthalic acid, terephthalic acid, and naphthalene dicarboxylic acid; aliphatic unsaturated dicarboxylic acid such as maleic acid, fumaric acid, itaconic acid, citraconic acid, glutaconic acid, isododecenyl succinic acid, n-dodecenyl succinic acid, and n-octenyl succinic acid; and carboxylic acid with valency of two or higher such as trimellitic acid, pyromellitic acid, naphthalene tricarboxylic acid, naphthalene tetracarboxylic acid, pyrene-tricarboxylic acid, and pyrene-tetracarboxylic acid. An acid anhydride and acid chloride thereof, or the like can be also mentioned.

Examples of the polyhydric alcohol for forming the amorphous polyester resin (B) include aliphatic diols such as ethylene glycol, 1,3-propane diol, 1,4-butane diol, 1,5-pentane diol, 1,6-hexane diol, 1,7-heptane diol, 1,8-octane diol, 1,9-nonane diol, 1,10-decane diol, 1,11-undecane diol, 1,12-dodecane diol, 1,13-tridecane diol, 1,14-tetradecane diol, 1,18-octadecane diol, and 1,20-eicosane diol; bisphenols such as bisphenol A and bisphenol F, and an alkylene oxide adduct of bisphenols such as ethylene oxide adduct and propylene oxide adduct thereof; and polyols with valency of three or higher such as glycerin, pentaerythritol, hexamethylol melamine, hexaethylol melamine, tetramethylol benzoguanamine, and tetraethylol benzoguanamine.

<Vinyl Polymerization Segment>

When the amorphous polyester resin (B) is a composite resin, examples of a polymerizable monomer for forming the vinyl polymerization segment include a monomer having an ethylenically unsaturated bond allowing radical polymerization. Specific examples thereof include a styrene monomer and a (meth)acrylic acid ester monomer, or the like.

Examples of the styrene monomer include styrene, o-methyl styrene, m-methyl styrene, p-methyl styrene, p-methoxystyrene, p-phenyl styrene, p-chlorostyrene, p-ethyl styrene, p-n-butyl styrene, p-tert-butyl styrene, p-n-hexyl styrene, p-n-octyl styrene, p-n-nonyl styrene, p-n-decyl styrene, p-n-dodecyl styrene, 2,4-dimethyl styrene, 3,4-dichlorostyrene, or the like, and their derivatives. It may be used either singly or in combination of two or more members.

Examples of the (meth)acrylic acid ester monomer include methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethylaminoethyl methacrylate, and diethylaminoethyl methacrylate, or the like. It may be used either singly or in combination of two or more members.

As for the styrene monomer and (meth)acrylic acid ester monomer for forming the vinyl polymerization segment, it is preferred to use the styrene monomer in a larger amount from the viewpoint of obtaining excellent charging property, excellent image quality property, or the like. Specifically, the use amount of the styrene monomer is preferably 50% by mass or more in the entire monomers that are used for forming the vinyl polymerization segment.

<Polyester Polymerization Segment>

When the amorphous polyester resin (B) is a composite resin, the polyhydric carboxylic acid (or its derivatives) and polyhydric alcohol (or its derivatives) can be the raw material of the polyester polymerization segment.

As for the polyhydric carboxylic acid, aliphatic unsaturated dicarboxylic acid such as fumaric acid, maleic acid, or mesaconic acid is preferably used. Further, in the present invention, it is also possible to use dicarboxylic acid anhydride, such as maleic acid anhydride.

A ratio between the polyhydric carboxylic acid and polyhydric alcohol is, in terms of an equivalent ratio of [OH]/[COOH] in which [OH] indicates hydroxy group of the polyhydric alcohol and [COOH] indicates carboxy group of the polyhydric carboxylic acid, preferably 1.5/1 to 1/1.5, and more preferably 1.2/1 to 1/1.2.

When the amorphous polyester resin (B) is a composite resin which is obtained by chemical binding between a vinyl polymerization segment and a polyester polymerization segment via a monomer capable of reacting with both the segment, a content of the vinyl polymerization segment (hereinbelow, also referred to as a "vinyl modification amount") is preferably 5 to 30% by mass, and particularly preferably 5 to 20% by mass. When it is within this range, a more desirable domain diameter can be easily attained from affinity between the amorphous resin (A) and the amorphous polyester resin (B).

The content of the vinyl polymerization segment in a composite resin, that is, the vinyl modification amount, is more specifically indicates a ratio of mass of a polymerizable monomer for forming the vinyl polymerization segment, relative to the total mass of resin materials that are used for synthesizing the composite resin, i.e., the total amount of a polymerizable monomer for forming the polyester polymerization segment, a polymerizable monomer for forming the vinyl polymerization segment, and a monomer capable of reacting with both the segment for binding them.

When the vinyl modification amount is within the range, affinity between the amorphous resin (A) for forming the matrix phase 11 and the amorphous polyester resin (B) for forming the domain phase 12 can be suitably controlled so that the toner particle 10 having a domain-matrix structure can be formed.

Further, it is preferable that, in the composite resin, aliphatic unsaturated dicarboxylic acid is used as a polyhydric carboxylic acid component for forming the polyester polymerization segment and a structural unit derived from the aliphatic unsaturated dicarboxylic acid is incorporated in the polyester polymerization segment. The aliphatic unsaturated dicarboxylic acid indicates chain type dicarboxylic acid which has a vinylene group in the molecule. The structural unit means a unit of a molecular structure, in the resin, which is derived from the monomer.

When the composite resin (the amorphous polyester resin (B)) having a structural unit derived from aliphatic unsaturated dicarboxylic acid is contained in the domain phase 12, sharp melting property originating from an ester group of the main chain of the amorphous polyester resin (B) can be given so that the toner can be provided with an effect of the low-temperature fixability.

According to the present invention, the polyhydric carboxylic acid for forming the amorphous polyester resin (B) preferably includes saturated linear aliphatic dicarboxylic acid with 6 or more carbon atoms, and preferably 6 to 12 carbon atoms. The saturated linear aliphatic dicarboxylic acid with 6 or more carbon atoms is contained at a ratio of 2 to 30 mol %, and preferably 5 to 15 mol %, relative to the total amount of the polyhydric carboxylic acid for forming the amorphous polyester resin (B).

By incorporating the saturated linear aliphatic dicarboxylic acid with 6 or more carbon atoms, the domain phase 12 can be more easily formed in the toner particle 10. In this regard, it is believed that, since the amorphous polyester resin (B) has both an ester binding site with high polarity and a long-chain type linear aliphatic site with low polarity, sites with similar polarity gather together so that domain phase 12 can be easily formed.

Further, a size of the domain phase 12 including the amorphous polyester resin (B) can be controlled based on a polarity difference between a site with high polarity and a site with low polarity in the amorphous polyester resin (B). It is believed that, the higher the carbon number of the long-chain type linear aliphatic site with low polarity is respect to the ester binding site with high polarity, the larger the difference in polarity becomes and the smaller the size of the domain phase is.

Further, to form a domain without compatibilization of the amorphous polyester resin (B) with the amorphous resin (A), it is preferable that the amorphous polyester resin (B) and the amorphous resin (A) do not have a similar structure and they suitably lack suitable affinity. As such, the amorphous polyester resin (B) which is formed by using the saturated linear aliphatic dicarboxylic acid with 6 or more carbon atoms and the amorphous resin (A) which is formed without using the saturated linear aliphatic dicarboxylic acid with 6 or more carbon atoms have no similar structure, and thus they allow to form a domain-matrix structure without compatibilization.

Further, the amorphous resin (A) is preferably a vinyl resin with excellent high-temperature off-set resistance. When the amorphous resin (A) is a vinyl resin, the amorphous polyester resin (B) lacks suitable affinity with the amorphous resin (A) so that it is difficult to have compatibilization between them. Accordingly, a domain-matrix structure can be formed.

Further, the amorphous polyester resin (B) formed by using the saturated linear aliphatic dicarboxylic acid with 6 or more carbon atoms and the amorphous resin (A) which is a vinyl resin formed without using a monomer having a linear alkyl group with 6 or more carbon atoms, can suppress formation of a domain phase having a domain diameter of 500 nm or more. As such, the domain phase C including a colorant can be homogeneously dispersed.

From the viewpoint of the low-temperature fixability, the amorphous polyester resin (B) of the present invention preferably has a glass transition point of 40 to 70° C., and more preferably 50 to 65° C. Further, it preferably has a softening point of 80 to 120° C., and more preferably 90 to 110° C.

<Method for Measurement of Glass Transition Point (Tg)>

The glass transition point of the amorphous polyester resin (B) can be measured by the same method as the amorphous resin (A) described above.

<Method for Measurement of Softening Point (Tsp)>

The softening point of the amorphous polyester resin (B) can be measured by the same method as the amorphous resin (A) described above.

It is preferred for the amorphous polyester resin (B) to have a molecular weight of preferably 10,000 to 200,000, and more preferably 15,000 to 100,000 in terms of weight average molecular weight.

<Method for Measurement of Molecular Weight>

The molecular weight of the amorphous polyester resin (B) can be measured by the same method as the amorphous resin (A) described above.

A content of the amorphous polyester resin (B) constituting the domain phase 12 is preferably 5 to 30% by mass, and more preferably 10 to 20% by mass of the total amount of the binder resin.

When the content of the amorphous polyester resin (B) is within the range, both effects of the high-temperature off-set resistance and fixing separability can be obtained.

<Method for Producing Amorphous Polyester Resin (B)>

As for the method for producing the amorphous polyester resin (B), a previously known general scheme can be used.

When the amorphous polyester resin (B) comprises a vinyl polymerization segment and a polyester polymerization segment that are bound to each other, it can be obtained according to the producing method described below.

(A) A method which comprises polymerizing the polyester polymerization segment in advance, reacting a bireactive monomer with the polyester polymerization segment, and further reacting with a polymerizable monomer for forming the vinyl polymerization segment, to form the vinyl polymerization segment. Namely, it is a method which comprises polymerizing a polymerizable monomer for forming the vinyl polymerization segment in the presence of a bireactive monomer having a group capable of reacting with polyhydric carboxylic acid or polyhydric alcohol for forming the polyester polymerization segment and a polymerizable unsaturated group, and a non-modified polyester resin.

(B) A method which comprises polymerizing the vinyl polymerization segment in advance, reacting a bireactive monomer with the vinyl polymerization segment, and further reacting with polyhydric carboxylic acid or polyhydric alcohol for forming the polyester polymerization segment, to form the polyester polymerization segment.

(C) A method which comprises polymerizing each of the polyester polymerization segment and the vinyl polymerization segment in advance, and reacting them with a bireactive monomer, to bind them each other.

(D) A method which comprises polymerizing the polyester polymerization segment in advance, and subjecting to addition polymerization of a polymerizable monomer for forming the vinyl polymerization segment with a polymerizable unsaturated group of the polyester polymerization segment or reacting it with a vinyl group of the vinyl polymerization segment, to bind them.

As described in the present invention, the bireactive monomer means a monomer which has a group capable of reacting with polyhydric carboxylic acid or polyhydric alcohol for forming the amorphous polyester resin (B) and a polymerizable unsaturated group.

(Use Ratio of Bireactive Monomer)

The use ratio of the bireactive monomer is, in terms of the ratio of bireactive monomer when the total amount of the resin materials for use is 100% by mass, preferably 0.1 to 5.0% by mass, and more preferably 0.5 to 3.0% by mass.

(Bireactive Monomer)

Specific examples of the bireactive monomer include acrylic acid, methacrylic acid, fumaric acid, maleic acid, and maleic anhydride, or the like.

In the present invention, it is preferable to use acrylic acid or methacrylic acid as a bireactive monomer.

In the present invention, a mixing ratio between the amorphous resin (A) constituting the matrix phase 11 and the amorphous polyester resin (B) constituting the domain phase 12 is preferably 70:30 to 95:5, and more preferably 80:20 to 90:10, in terms of mass ratio.

When the mixing ratio between the amorphous resin (A) and the amorphous polyester resin (B) is within the range, both the low-temperature fixability and high-temperature off-set resistance can be obtained and also the colorant can be homogeneously dispersed. As such, not only good image density can be obtained but also uniform image density can be ensured.

As for the binder resin, a resin other than the amorphous resin (A) and the amorphous polyester resin (B) may be also contained.

<Colorant>

As for the colorant constituting the toner particle 10, carbon black, a magnetic material, a dye, a pigment, or the like can be arbitrarily used.

Examples of the carbon black which can be used include channel black, furnace black, acetylene black, thermal black, and lamp black, or the like.

Examples of the magnetic material which can be used include a ferromagnetic metal such as iron, nickel, and cobalt, an alloy containing those metals, and a compound of a ferromagnetic metal such as ferrite and magnetite.

Examples of the pigment which can be used include C.I. Pigment Red 2, C.I. Pigment Red 3, C.I. Pigment Red 5, C.I. Pigment Red 7, C.I. Pigment Red 15, C.I. Pigment Red 16, C.I. Pigment Red 48:1, C.I. Pigment Red 48:3, C.I. Pigment Red 53:1, C.I. Pigment Red 57:1, C.I. Pigment Red 81:4, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 208, C.I. Pigment Red 209, C.I. Pigment Red 222, C.I. Pigment Orange 31, C.I. Pigment Orange 43, Pigment Yellow 3, C.I. Pigment Yellow 9, C.I. Pigment Yellow 14, C.I. Pigment Yellow 17, C.I. Pigment Yellow 35, C.I. Pigment Yellow 36, C.I. Pigment Yellow 65, C.I. Pigment Yellow 74, C.I. Pigment Yellow 83, C.I. Pigment Yellow 93, C.I. Pigment Yellow 94, C.I. Pigment Yellow 98, C.I. Pigment Yellow 110, C.I. Pigment Yellow 111, C.I. Pigment Yellow 138, C.I. Pigment Yellow 139, C.I. Pigment Yellow 153, C.I. Pigment Yellow 155, C.I. Pigment Yellow 180, C.I. Pigment Yellow 181, C.I. Pigment Yellow 185, C.I. Pigment Green 7, C.I. Pigment Blue 15:3, C.I. Pigment Blue 15:4, C.I. Pigment Blue 60, and a phthalocyanine pigment having zinc, titanium, magnesium or the like as a center metal. A mixture of them can be also used. Examples of the dye which can be used include C.I. Solvent Red 1, C.I. Solvent Red 3, C.I. Solvent Red 14, C.I. Solvent Red 17, C.I. Solvent Red 18, C.I. Solvent Red 22, C.I. Solvent Red 23, C.I. Solvent Red 49, C.I. Solvent Red 51, C.I. Solvent Red 52, C.I. Solvent Red 58, C.I. Solvent Red 63, C.I. Solvent Red 87, C.I. Solvent Red 111, C.I. Solvent Red 122, C.I. Solvent Red 127, C.I. Solvent Red 128, C.I. Solvent Red 131, C.I. Solvent Red 145, C.I. Solvent Red 146, C.I. Solvent Red 149, C.I. Solvent Red 150, C.I. Solvent Red 151, C.I. Solvent Red 152, C.I. Solvent Red 153, C.I. Solvent Red 154, C.I. Solvent Red 155, C.I. Solvent Red 156, C.I. Solvent Red 157, C.I. Solvent Red 158, C.I. Solvent Red 176, C.I. Solvent Red 179, pyrazolotriazole azo dye, pyrazolotriazole azomethine dye, pyrazolone azo dye, pyrazolone azomethine dye, C.I. Solvent Yellow 19, C.I. Solvent Yellow 44, C.I. Solvent Yellow 77, C.I. Solvent Yellow 79, C.I. Solvent Yellow 81, C.I. Solvent Yellow 82, C.I. Solvent Yellow 93, C.I. Solvent Yellow 98, C.I. Solvent Yellow 103, C.I. Solvent Yellow 104, C.I. Solvent Yellow 112, C.I. Solvent Yellow 162, C.I. Solvent Blue 25, C.I. Solvent Blue 36, C.I. Solvent Blue 60, C.I. Solvent Blue 70, C.I. Solvent Blue 93, C.I. Solvent Blue 95. A mixture of them can be also used.

A content of the colorant is preferably 1 to 30% by mass, and more preferably 2 to 20% by mass, relative to the binder resin.

It is preferable that the colorant is dispersed, in the matrix phase 11 including the amorphous resin (A) of the toner particle 10, as a domain C which is different from the amorphous polyester resin (B). Further, the number average domain diameter of the domain phase C including a colorant is, although it may vary depending on the type, preferably 10 to 300 nm, and more preferably 10 to 200 nm in general.

<Releasing Agent>

When the toner particle 10 is constituted to contain a releasing agent, wax can be used as a releasing agent. Examples of the wax include hydrocarbon waxes such as low molecular weight polyethylene wax, low molecular weight polypropylene wax, Fischer Tropsh wax, microcrystalline wax, and paraffin wax, and ester waxes such as Carnauba wax, pentaerythritol behenate, pentaerythritol tetrastearate, behenyl behenate and behenyl citrate. It may be used either singly or in combination of two or more members. Pentaerythritol behenate and pentaerythritol tetrastearate are preferred as wax.

From the viewpoint of surely obtaining the low-temperature fixability and releasing property of the toner, a releasing agent with melting point of 50 to 95° C. is preferably used.

A content of the releasing agent is preferably 2 to 20% by mass, more preferably 3 to 18% by mass, and still more preferably 4 to 15% by mass, relative to the binder resin.

It is preferable that the releasing agent is dispersed, in the matrix phase 11 of the toner particle 10, as a domain phase which is different from the amorphous polyester resin (B). By forming a separate and independent domain phase, each function is likely to be exhibited. For example, when a toner is manufactured in an aqueous medium, the releasing agent easily forms a domain phase which is different from the amorphous polyester resin (B) when a toner is produced in a state in which the releasing agent is coated with a resin. Since the amorphous polyester resin (B) and a wax as a releasing agent are not compatible with each other and present as a separate and independent domain phase in the matrix phase 11, each function originated from the amorphous polyester resin (B) and the releasing agent can be sufficiently expressed without being impaired. As such, a toner having good low-temperature fixability, fixing separability, and off-set property on a rough paper can be provided.

The number average domain diameter of the domain phase including a releasing agent is preferably in the range of 100 nm to 1 μm, and more preferably in the range of 100 nm to 500 nm. When it is within this range, a sufficient releasing effect can be obtained.

<Charge Controlling Agent>

When the toner particle 10 is constituted to contain a charge controlling agent, various well-known charge controlling agents can be used as a charge controlling agent.

As for the charge controlling agent, various well-known compounds which can be dispersed in an aqueous medium can be used. Specific examples thereof include a nigrosine dye, a metal salt of naphthenic acid and a higher fatty acid, alkoxylated amine, a quaternary ammonium salt compound, an azo metal complex and a metal salt of salicylic acid or its metal complex salt, and the like.

A content of the releasing agent is preferably 0.1 to 10% by mass, and more preferably 0.5 to 5% by mass, relative to the binder resin.

<<Description of Toner Particles>>

The toner particle 10 according to the present invention can be used by itself as a toner particle. However, it is generally preferable to use it after addition with and external additive.

<Average Circularity of Toner Particle>

An average circularity of the toner particle 10 is preferably 0.850 to 0.990.

The average circularity of the toner particle is a value measured by using a flow type particle image measuring device "FPIA-2100" (manufactured by Sysmex Corporation).

Specifically, toner particles are wetted with an aqueous solution of a surfactant and dispersed for 1 minute by an ultrasonic dispersion treatment. By using "FPIA-2100", the measurement is performed with measurement condition set to HPF (high power imaging) mode and an optimum concentration including the HPF detection number of 3,000 to 10,000. When it is within this range, measurement values with reproducibility can be obtained. The circularity is calculated according to the following formula.

Circularity=(Circumference length of a circle having the same projection area as a particle image)/(Circumference length of a projection image of a particle)

Further, the average circularity corresponds to an arithmetic average value which is obtained by dividing the sum of circularity of each particle by the number of entire particles that are measured.

<Particle Diameter of Toner Particles>

A particle diameter of the toner particle 10 is, in terms of a volume average particle diameter ($D_{50}$% diameter), that is, a volume-based median diameter, preferably not less than 3 μm and not more than 10 μm.

When the volume-based median diameter is within the foregoing range, a minute dot image, for example, at a level of 1200 dpi (dpi is the number of dots per inch (2.54 cm)) can be faithfully reproduced.

The volume-based median diameter ($D_{50}$% diameter) of the toner particle can be measured and calculated as described above by using the device in which "Multisizer 3" (manufactured by Beckman Coulter Inc.) connected to a computer system equipped with "Software V3.51", which is a software for data processing.

With regard to the measurement procedure, 0.02 g of a measurement sample (toner) is added to a 20 ml surfactant solution (for example, surfactant solution obtained by diluting a neutral detergent containing a surfactant component by 10 times with pure water for the purpose of dispersing toner particles therein) for uniform dispersion, and then subjected to ultrasonic dispersion for 1 minute, to produce the toner particle dispersion. The toner particle dispersion is introduced by a pipette into a beaker containing ISOTON II (manufactured by Beckman Coulter Inc.) placed in a sample stand until a measured concentration reaches 5 to 10%. The measurement is made while the measuring device count is set to 25,000 particles. Meanwhile, Multisizer 3 with an aperture diameter of 100 μm is used. A measurement range of 2 to 60 μm is divided to 256 parts and the frequency of an individual part is calculated and the particle diameter at 50% of volume fraction from the larger side is defined as the volume-based median diameter ($D_{50}$% diameter).

<Softening Point of Toner>

A softening point of the toner of the present invention is preferably 90 to 120° C. When the softening point of the toner is within this range, preferable low-temperature fixability can be obtained.

The measurement of the softening point of the toner can be made according to the aforementioned method, that is, by using "Flow Tester CFT-500D" (manufactured by Shimadzu Corporation).

<<Method for Manufacturing Toner>

Examples of the method for manufacturing the toner of the present invention may include a suspension polymerization method, an emulsion aggregation method, and other known methods. It is preferable to use an emulsion aggregation method.

With an emulsion aggregation method, toner particles with a small particle diameter can be easily obtained, which is preferable from the viewpoint of manufacturing cost and manufacturing stability.

As used herein, the emulsion aggregation method is a method which comprises mixing a dispersion of microparticles of a binder resin (hereinafter, also referred to as "binder resin microparticles") manufactured by emulsion polymerization optionally with a dispersion of microparticles of a colorant (hereinafter, also referred to as "colorant microparticles"), inducing aggregation until a desired diameter of a toner particle is obtained, and performing fusion between binder resin microparticles to control the shape, to produce a toner. Herein, the binder resin microparticles may contain a releasing agent, a charge controlling agent, or the like, as necessary.

With regard to a method for manufacturing the toner of the present invention by an emulsion aggregation method, an aqueous dispersion of microparticles of the amorphous resin (A), an aqueous dispersion of microparticles of the amorphous polyester resin (B), and an aqueous dispersion of colorant microparticles are mixed with one another for aggregating each microparticle followed by fusion, to manufacture toner particles having a domain-matrix structure, for example.

When a toner having a vinyl resin as the amorphous resin (A) is manufactured by an emulsion aggregation method, specific production examples are as follows.

Toner particles are formed through:

(a) a step of preparing a dispersion of microparticles of the amorphous resin (A) in an aqueous medium, that is, a step which comprises forming microparticles of the amorphous resin (A) by polymerization in an aqueous medium, to produce an aqueous dispersion of resin microparticles in which microparticles of the amorphous resin (A) are dispersed, (b) a step of preparing a dispersion of microparticles of the amorphous polyester resin (B) in an aqueous medium, (c) a step of preparing a dispersion of colorant microparticles in an aqueous medium, and (d) a step which comprises mixing the dispersion of microparticles of the amorphous resin (A), the dispersion of microparticles of the amorphous polyester resin (B), and the dispersion of colorant microparticles to aggregate the microparticles of the amorphous resin (A), the microparticles of the amorphous polyester resin (B), and the colorant microparticles, and then adjusting the shape of toner particles by fusion and aging with heat energy. After that, the toner particles may be subjected to a washing step, a drying step, or a step for adding an external additive, as necessary.

The microparticles of the amorphous resin (A) in the step (a) above may have a multi-layer structure with two or more layers including a resin with a different composition. The resin microparticles with such constitution, for example, a bilayer structure, can be obtained by preparing a dispersion of resin microparticles by an emulsion polymerization treatment (first stage polymerization) according to a common method and performing polymerization of the system by adding a polymerization initiator and a polymerizable monomer to the dispersion (second stage polymerization). Further, as necessary, a three-layer constitution may be formed by further adding another polymerizable monomer and performing a third stage polymerization.

After the aforementioned step (d), it is also possible to further perform a washing step which comprises separating by filtration the toner particles from the aqueous dispersion of the toner particles and removing a surfactant or the like from the toner particles, a drying step which comprises drying the toner particles after the washing treatment, and, as necessary, a step of adding an external additive which comprises adding an external additive to the dried toner particles may be performed, to manufacture toner particles.

The "aqueous medium" as used herein indicates a medium which includes 50 to 100% by mass of water and 0 to 50% by mass of a water-soluble organic solvent. Examples of the water-soluble organic solvent may include methanol, ethanol, isopropanol, butanol, acetone, methyl ethyl ketone, and tetrahydrofuran. An alcoholic organic solvent which does not dissolve a resin to be obtained is preferable.

(Step for Preparing Dispersion of Microparticles of Amorphous Resin (A))

A dispersion of microparticles of the amorphous resin (A) can be prepared by emulsion polymerization.

When a surfactant is used for the step for polymerization of the amorphous resin (A), examples of the surfactant which can be used include the aforementioned surfactants.

In the toner particles according to the present invention, the amorphous resin (A) and the amorphous polyester resin (B) are contained as a binder resin and, as necessary, internal additives such as a colorant, a releasing agent, a charge controlling agent, or magnetic powder may be contained. Those internal additives can be incorporated to the toner particles by dissolving or dispersing them in advance in a monomer solution for forming the amorphous resin (A) in the step for polymerization of the amorphous resin (A).

Further, although the internal additives can be incorporated to the toner particles by separately preparing a dispersion of microparticles of internal additives which consists only of the internal additives, and aggregating the microparticles of the internal additives with resin microparticles and colorant microparticles during a step for forming the toner particles, a method of incorporating them in advance in a step for polymerization of a binder resin is preferably adopted.

An average particle diameter of microparticles of the amorphous resin (A) is, in terms of a volume-based median diameter, preferably in the range of 50 to 500 nm, for example.

Meanwhile, the volume-based median diameter is measured by using "UPA-150" (manufactured by Microtrac).

With regard to the toner of the present invention, examples of a method for preparing a dispersion of microparticles of the amorphous resin (A) when the amorphous resin (A) is an amorphous polyester resin include a method which comprises pulverizing the amorphous resin (A) by a mechanical process and dispersing in an aqueous medium by using a surfactant, a method which comprises placing and dispersing a solution of the amorphous resin (A) dissolved in an organic solvent in an aqueous medium to obtain an aqueous medium dispersion, a method which comprises mixing the amorphous resin (A) in a melt state with an aqueous medium and subjecting to mechanical dispersion process to obtain an aqueous medium dispersion, and a phase inversion emulsification method. In the present invention, any one of those methods can be used.

(Method for Preparing Dispersion of Microparticles of Amorphous Polyester Resin (B))

With regard to a dispersion of microparticles of the amorphous polyester resin (B), there can be exemplified a method which comprises pulverizing the amorphous polyester resin (B) by a mechanical process and dispersing in an aqueous medium by using a surfactant, a method which comprises placing and dispersing a solution of the amorphous resin (B) dissolved in an organic solvent in an aqueous medium to obtain an aqueous medium dispersion, a method which comprises mixing the amorphous resin (B) in a melt state with an aqueous medium and subjecting to mechanical dispersion process to obtain an aqueous medium dispersion, and a phase inversion emulsification method. In the present invention, any one of those methods can be used.

An average particle diameter of microparticles of the amorphous polyester resin (B) is, in terms of a volume-based median diameter, preferably in the range of 50 to 200 nm, for example. More preferably, it is within the range of 100 to 150 nm.

When the average particles diameter of the microparticles of the amorphous polyester resin (B) is within the above range, the domain diameter of a domain phase including the amorphous polyester resin (B) can be adjusted to 100 to 200 nm so that generation of a domain phase with a large particle diameter of 500 nm or more can be suppressed.

As for the surfactant, the same surfactants as those described above can be used.

(Step for Preparing Dispersion of Colorant Microparticles)

A dispersion of colorant microparticles can be prepared by dispersing a colorant in an aqueous medium. From the viewpoint of homogeneous dispersion of a colorant, the treatment for dispersing a colorant is preferably performed in a state in which the concentration of a surfactant in an aqueous medium is equal to or higher than the critical micelle concentration (CMC). As a disperser used for a dispersing treatment of a colorant, various well-known dispersers can be used.

As the surfactant to be used, the same surfactants as those described above can be used.

A diameter of the colorant microparticles to be dispersed is, in terms of a volume-based median diameter, preferably in the range of 10 to 300 nm. More preferably, it is within the range of 10 to 200 nm. By preparing a dispersion of the colorant microparticles having such a dispersion diameter, a suitable domain particle diameter of the domain phase C, which includes a colorant, in the toner particles to be obtained can be achieved.

The volume-based median diameter of the colorant microparticle in a dispersion of the colorant microparticles is measured by using an electrophoretic light scattering photometer "ELS-800" (manufactured by Otsuka Electronics Co., Ltd.).

(Step for Forming Toner Particles)

According to the step for forming the toner particles, as necessary, microparticles of other toner-constituting components such as a releasing agent like wax or a charge controlling agent can be aggregated, together with the microparticles of the amorphous resin (A), microparticles of the amorphous polyester resin (B), and microparticles of colorant.

The specific method for aggregating and fusing the microparticles of the amorphous resin (A), microparticles of the amorphous polyester resin (B), and microparticles of colorant is as follows: an aggregating agent is added to an aqueous medium so as to give a concentration equal to or higher than the critical aggregation concentration, salting-out of the microparticles of the amorphous resin (A), microparticles of the amorphous polyester resin (B), and microparticles of colorant is performed simultaneously with fusion by heating at a temperature which is equal to or higher than a glass transition point of resin microparticles but equal to or lower than a melt peak temperature of the mixture, particle growth is terminated by adding an aggregation terminator when the growth is progressed to a desired particle diameter, and also, as necessary, heating is further continued to control the particle shape.

In this method, it is preferable that the time for keeping after addition of an aggregating agent be as short as possible and the heating is performed at a temperature which is equal to or higher than a glass transition point of resin microparticles but equal to or lower than a melt peak temperature of the mixture. That is because, although the reason is not entirely clear, there is a concern regarding an occurrence of problems like unstable particle diameter distribution due to a change in an aggregation state of particle, or a change in surface property of the fused particles in accordance with the keeping time after salting-out. A period until the temperature increase is preferably 30 minutes or shorter, and more preferably 10 minutes or shorter. Further, a temperature-increasing rate is 1° C./minute or more. Although the upper limit of the temperature-increasing rate is not particularly limited, from the viewpoint of suppressing occurrence of coarse particles caused by rapid progress of fusion, it is preferably 15° C./minute or less. After the reaction system reaches a temperature which is equal to or higher than the glass transition point, it is important to continue the fusion by maintaining the temperature of the reaction system for a certain period of time. By this, the toner particle growth and fusion can be effectively progressed, and thus durability of the toner particles that are finally obtained can be improved.

In the present invention, by mixing the amorphous resin (A) and the amorphous polyester resin (B) before starting heating in the aggregation step and aggregating them simultaneously, the number average domain diameter of a domain phase of the amorphous polyester resin (B) can be adjusted to the range of 100 to 200 nm.

(Aggregating Agent)

An aggregating agent used for the step for forming the toner particles is not particularly limited but one selected from metal salts is preferably used. Examples of the metal salts may include a salt of a monovalent metal such as alkali metal such as sodium, potassium or lithium; a salt of a divalent metal such as calcium, magnesium, manganese or copper; and a salt of a trivalent metal such as iron or aluminum. Specific examples of the metal salts include sodium chloride, potassium chloride, lithium chloride, calcium chloride, manganese chloride, zinc chloride, copper sulfate, magnesium sulfate and manganese sulfate. Of these salts, a divalent metal salt is preferably used from the viewpoint that the aggregation can be achieved by use of a smaller amount. It may be used either singly or in combination of two or more members.

A particle diameter of the toner particles that are obtained by the step for forming the toner particles is, in terms of a volume-based median diameter ($D_{50}$% diameter), for example, preferably in the range of 2 to 9 μm, and more preferably 4 to 7 μm.

The volume-based median diameter of the toner particles is measured by using "Multisizer 3" (manufactured by Beckman Coulter, Inc.).

(Aging Step)

By controlling a heating temperature in the aforementioned step for forming the toner particles, uniform shape of the toner particles in the toner can be achieved at a certain level. In order to achieve more uniform shape, it is preferable to perform an aging process.

In the aging step, a surface of the toner particle, which is formed to have a constant particle diameter with narrow distribution, can be controlled to have a smooth but uniform shape by controlling the temperature and time for heating. Specifically, by slightly lowering a heating temperature in the step for forming tone particles, a progress of the fusion between resin microparticles is suppressed to promote homogenization, and also, by having slightly lower heating temperature and longer time in the aging step, the toner particles are controlled to have desired average circularity, that is, a shape with an even surface.

(Washing Step and Drying Step)

The washing step and the drying step can be performed by adopting various well-known methods. Specifically, after aging to desired average circularity in the aforementioned aging step, washing may be performed by solid-liquid separation by a well-known method using a centrifuge, for example, an organic solvent is removed by drying under reduced pressure, and moisture and a trace amount of the organic solvent are removed by using a well-known drying apparatus such as a flash jet dryer or a fluid bed drying apparatus. The drying temperature can be any temperature at which the toner is not fused.

(Method for Adding External Additive)

The step for adding an external additive is a step for adding, as necessary, an external additive to the toner particles obtained after the drying treatment followed by mixing to prepare the toner particles.

The toner particles which are produced through the steps including the drying step can be used by itself as toner particles. From the viewpoint of improving electrostatic charging characteristics, fluidity, or cleaning property as a toner, it is preferable to add particles such as well-known inorganic microparticles or organic microparticles and a lubricant as the external additive to the surface of the particles.

Various external additives may be used in combination as the external additive.

Examples of the inorganic microparticles include inorganic oxide microparticles such as silica microparticles, alumina microparticles and titanium oxide microparticles; inorganic stearic acid compound microparticles such as aluminum stearate microparticles and zinc stearate microparticles; and inorganic titanic acid compound microparticles such as strontium titanate and zinc titanate.

These inorganic microparticles which are subjected to surface modification with a silane coupling agent, a titanium coupling agent, a higher fatty acid, a silicone oil or the like, are preferred in terms of heat resistant storability and environmental stability.

The external additive is added preferably in an amount of 0.05 to 5 parts by mass, and more preferably 0.1 to 3 parts by mass, relative to 100 parts by mass of the toner particles.

Examples of the method for adding the external additive include a dry process which comprises adding the external additive in a powdery form to dried toner particles. Examples of a mixing device include a mechanical mixing device such as a Henschel mixer or a coffee mill.

<Developer>

The toner of the present invention is usable as a magnetic or non-magnetic one-component developer. However, it is also usable as a two-component developer after mixing with a carrier.

As for the carrier, magnetic particles including well-known materials in the past, for example, a metal such as iron, ferrite or magnetite, an alloy of the foregoing metal and a metal of aluminum or lead can be used. Of these, ferrite particles are preferably used. Further, there may be used as a carrier a coated carrier having the surfaces of magnetic particles covered with a covering agent such as a resin, and a resin dispersion type carrier having a fine powdery magnetic material dispersed in a binder resin.

As for the carrier, those having a volume average particle diameter of 15 to 100 μm are preferable, and those with 25 to 80 μm are more preferable.

According to the toner described above which includes toner particles having a domain-matrix structure including the amorphous polyester resin (B) dispersed, as the domain phase 12, in the matrix phase 11 including the amorphous resin (A), in which the number average domain diameter of the domain phase 12 is 100 to 200 nm and the area ratio of a domain phase having a domain diameter of 500 nm or more relative to the total area of the domain phase 12 is 0 to 10%, excellent low-temperature fixability and high-temperature off-set resistance can be attained, good image density can be obtained, and excellent homogeneity in image density can be also attained.

Examples

Hereinbelow, the present invention will be described specifically with reference to examples, but the present invention is not limited to them.

[Preparation of Dispersion of Amorphous Resin Microparticles (A1)]

(1) First Stage Polymerization

To a 5 L reaction vessel equipped with a stirrer, a temperature sensor, a condenser, and an inlet for nitrogen, 4 g of sodium polyoxyethylene-2-dodecyl ether sulfate and 3000 g of ion exchange water were placed and an internal temperature was raised to 80° C., while stirring at a stirring rate of 230 rpm under nitrogen stream.

After increasing the temperature, an aqueous solution containing 10 g of potassium persulfate (KPS) dissolved in 200 g of ion exchange water was added thereto, and after adjusting the liquid temperature to 75° C., a monomer mixture solution [a] including 568 g of styrene (ST), 164 g of n-butyl acrylate (BA), and 68 g of methacrylic acid (MAA) was added dropwise thereto over 1 hour. After the completion of the dropwise addition, the mixture was heated and stirred at 75° C. for 2 hours to perform polymerization (first stage polymerization). Accordingly, a dispersion of resin microparticles [a] was prepared.

(2) Second Stage Polymerization

To a 5 L reaction vessel equipped with a stirrer, a temperature sensor, a condenser, and an inlet for nitrogen, a solution containing 2 g of sodium polyoxyethylene-2-dodecyl ether sulfate dissolved in 3000 g of ion exchange water was placed and heated to 80° C. Then, the dispersion of resin microparticles [a] in an amount of 42 g in terms of solid content and a monomer mixture liquid [b] to prepared by dissolving 70 g of behenyl behenate as a releasing agent at 80° C. in a mixture including 195 g of styrene (ST), 91 g of n-butyl acrylate (BA), 20 g of methacrylic acid (MAA), and 3 g of n-octyl mercaptan were added thereto, which was then mixed and dispersed for 1 hour by using a mechanical disperser provided with a circulation path (CLEAMIX, manufactured by M Technique Co., Ltd.), to prepare a dispersion containing emulsified particles (oil droplets).

Subsequently, to this dispersion, an initiator solution containing 5 g of a potassium persulfate (KPS) dissolved in 100 g of ion exchange water was added and the system was heated and stirred at 80° C. for 1 hour to perform polymerization (second stage polymerization), whereby a dispersion of resin microparticles [b] was prepared.

(3) Third Stage Polymerization

To a dispersion of the resin microparticles [b], an initiator solution containing 10 g of potassium persulfate (KPS) dissolved in 200 g of ion exchange water was added, and a monomer mixture solution [c] including 315 g of styrene (ST), 145 g of n-butyl acrylate (BA), 32 g of methacrylic acid (MAA), and 6 g of n-octyl mercaptan was added dropwise thereto over 1 hour at 80° C. After the completion of the dropwise addition, the mixture was heated and stirred for 2 hours to perform polymerization (third stage polymerization), which was then cooled to 28° C., to prepare a dispersion of amorphous resin microparticles (A1) having microparticles of an amorphous resin (styrene-acrylic resin) having a volume-based median diameter of 168 nm and containing a releasing agent dispersed in an aqueous medium.

[Preparation of Dispersion of Amorphous Resin Microparticles (A2)]

(1) Production of Amorphous Resin (A2)

To a four-necked flask equipped with an inlet for nitrogen, a dehydration tube, a stirrer, and a thermocouple, 50 g of bisphenol A ethylene oxide 2 mol adduct (BPA-EO), 249 g of bisphenol A propylene oxide 2 mol adduct (BPA-PO), 91 g of terephthalic acid (TPA), 46 g of fumaric acid (FA), and 2 g of an esterification catalyst (tin octylate) were placed and subjected to polycondensation reaction for 8 hours at 230° C. By further performing the reaction for 1 hour at 8 kPa, an amorphous resin (A2), which is an amorphous polyester resin, was obtained.

(2) Preparation of Dispersion of Amorphous Resin Microparticles (A2)

By using "Randel Mill Type: RM" (manufactured by TOKUJU CORPORATION), 100 g of the amorphous resin (A2) was pulverized and mixed with 638 g of sodium lauryl sulfate solution with a concentration of 0.26% by mass, which had been previously produced. The mixture was dispersed by an ultrasonic homogenizer "US-150T" (manufactured by NISSEI Corporation) at V-LEVEL, 300 μA over 60 minutes under stirring, to prepare a dispersion of amorphous resin microparticles (A2) having microparticles of an amorphous resin (amorphous polyester resin) having a volume-based median diameter of 160 nm dispersed therein.

[Preparation of Dispersion of Amorphous Resin Microparticles (A3)]

A dispersion of the amorphous resin microparticles (A3) having microparticles of an amorphous resin (styrene-acrylic resin) having a volume-based median diameter of 194 nm and containing a releasing agent dispersed in an aqueous medium was prepared in the same manner as the preparation of the dispersion of amorphous resin microparticles (A1), except that n-butyl acrylate in the first stage polymerization, the second stage polymerization, and the third stage polymerization was changed to n-lauryl acrylate (LA; carbon number of 12).

[Preparation of Dispersion of Amorphous Resin Microparticles (A4)]

(1) Production of Amorphous Resin (A4)

To a four-necked flask equipped with an inlet for nitrogen, a dehydration tube, a stirrer, and a thermocouple, 50 g of bisphenol A ethylene oxide 2 mol adduct (BPA-EO), 249 g of bisphenol A propylene oxide 2 mol adduct (BPA-PO), 91 g of terephthalic acid (TPA), 35 g of fumaric acid (FA), 15 g of sebacic acid, and 2 g of an esterification catalyst (tin octylate) were placed and subjected to polycondensation reaction for 8 hours at 230° C. By further performing the reaction for 1 hour at 8 kPa, an amorphous resin (A4), which is an amorphous polyester resin, was obtained.

(2) Preparation of Dispersion of Amorphous Resin Microparticles (A4)

By using "Randel Mill Type: RM" (manufactured by TOKUJU CORPORATION), 100 g of the amorphous resin (A4) was pulverized and mixed with 638 g of sodium lauryl sulfate solution with a concentration of 0.26% by mass, which had been previously produced. The mixture was dispersed by an ultrasonic homogenizer "US-150T" (manufactured by NISSEI Corporation) at V-LEVEL, 300 μA over 60 minutes under stirring, to prepare a dispersion of amorphous resin microparticles (A4) having microparticles of an amorphous resin (amorphous polyester resin) having a volume-based median diameter of 120 nm dispersed therein.

[Preparation of Dispersion of Amorphous Resin Microparticles (A5)]

(1) Production of Amorphous Resin (A5)

To a four-necked flask equipped with an inlet for nitrogen, a dehydration tube, a stirrer, and a thermocouple, 50 g of bisphenol A ethylene oxide 2 mol adduct (BPA-EO), 249 g of bisphenol A propylene oxide 2 mol adduct (BPA-PO), 91 g of terephthalic acid (TPA), 35 g of fumaric acid (FA), 15 g of adipic acid, and 2 g of an esterification catalyst (tin octylate) were placed and subjected to polycondensation reaction for 8 hours at 230° C. By further performing the reaction for 1 hour at 8 kPa, an amorphous resin (A5), which is an amorphous polyester resin, was obtained.

(2) Preparation of Dispersion of Amorphous Resin Microparticles (A5)

By using "Randel Mill Type: RM" (manufactured by TOKUJU CORPORATION), 100 g of the amorphous resin (A5) was pulverized and mixed with 638 g of sodium lauryl sulfate solution with a concentration of 0.26% by mass, which had been previously produced. The mixture was dispersed by an ultrasonic homogenizer "US-150T" (manufactured by NISSEI Corporation) at V-LEVEL, 300 μA over 60 minutes under stirring, to prepare a dispersion of amorphous resin microparticles (A5) having microparticles of an amorphous resin (amorphous polyester resin) having a volume-based median diameter of 135 nm dispersed therein.

[Preparation of Dispersion of Amorphous Polyester Resin Microparticles (B1)]

(1) Production of Amorphous Polyester Resin (B1)

To a four-necked flask equipped with an inlet for nitrogen, a dehydration tube, a stirrer, and a thermocouple, 100 g of bisphenol A ethylene oxide 2 mol adduct (BPA-EO), 189 g of bisphenol A propylene oxide 2 mol adduct (BPA-PO), 76 g of terephthalic acid (TPA), 41 g of fumaric acid (FA), 28 g of adipic acid, and 2 g of an esterification catalyst (tin octylate) were placed and subjected to polycondensation reaction for 8 hours at 230° C. By further performing the reaction for 1 hour at 8 kPa, an amorphous polyester resin (B1) was obtained.

(2) Preparation of Dispersion of Amorphous Polyester Resin Microparticles (B1)

By using "Randel Mill Type: RM" (manufactured by TOKUJU CORPORATION), 100 g of the amorphous polyester resin (B1) was pulverized and mixed with 638 g of sodium lauryl sulfate solution with a concentration of 0.26% by mass, which was previously produced. The mixture was dispersed by an ultrasonic homogenizer "US-150T" (manufactured by NISSEI Corporation) at V-LEVEL, 300 μA over 60 minutes under stirring, to prepare a dispersion of amorphous polyester resin microparticles (B1) having amorphous polyester resin microparticles having a volume-based median diameter of 140 nm dispersed therein.

[Preparation of Dispersion of Amorphous Polyester Resin Microparticles (B2)]

(1) Production of Amorphous Polyester Resin (B2)

To a four-necked flask equipped with an inlet for nitrogen, a dehydration tube, a stirrer, and a thermocouple, 100 g of bisphenol A ethylene oxide 2 mol adduct (BPA-EO), 189 g of bisphenol A propylene oxide 2 mol adduct (BPA-PO), 76 g of terephthalic acid (TPA), 41 g of fumaric acid (FA), 28 g of sebacic acid, and 2 g of an esterification catalyst (tin octylate) were placed and subjected to polycondensation reaction for 8 hours at 230° C. By further performing the reaction for 1 hour at 8 kPa, an amorphous polyester resin (B2) was obtained.

(2) Preparation of Dispersion of Amorphous Polyester Resin Microparticles (B2)

By using "Randel Mill Type: RM" (manufactured by TOKUJU CORPORATION), 100 g of the amorphous polyester resin (B2) was pulverized and mixed with 638 g of sodium lauryl sulfate solution with a concentration of 0.26% by mass, which was previously produced. The mixture was dispersed by an ultrasonic homogenizer "US-150T" (manufactured by NISSEI Corporation) at V-LEVEL, 300 μA over 60 minutes under stirring, to prepare a dispersion of amorphous polyester resin microparticles (B2) having amorphous polyester resin microparticles having a volume-based median diameter of 170 nm dispersed therein.

[Preparation of Dispersion of Amorphous Polyester Resin Microparticles (B3)]

(1) Production of Amorphous Polyester Resin (B3)

To a four-necked flask equipped with an inlet for nitrogen, a dehydration tube, a stirrer, and a thermocouple, 100 g of bisphenol A ethylene oxide 2 mol adduct (BPA-EO), 189 g of bisphenol A propylene oxide 2 mol adduct (BPA-PO), 51 g of terephthalic acid (TPA), 61 g of fumaric acid (FA), 25 g of adipic acid, and 2 g of an esterification catalyst (tin octylate) were placed and subjected to polycondensation reaction for 8 hours at 230° C. By further performing the reaction for 1 hour at 8 kPa and cooling to 160° C., a mixture containing 6 g of acrylic acid (AA), 70 g of styrene (ST), 31 g of n-butyl acrylate (BA), and 20 g of a polymerization initiator (di-t-butyl peroxide) was added over 1 hour by using a dropping funnel. After the dropwise addition, the addition polymerization reaction was continued for 1 hour while maintaining 160° C. Then, the temperature was raised to 200° C. and it was maintained for 1 hour at 10 kPa. Thereafter, by removing the unreacted acrylic acid, styrene, and butyl acrylate, an amorphous polyester resin (B3) as a composite resin including a vinyl polymerization segment and a polyester polymerization segment that are bound to each other was obtained.

(2) Preparation of Dispersion of Amorphous Polyester Resin Microparticles (B3)

By using "Randel Mill Type: RM" (manufactured by TOKUJU CORPORATION), 100 g of the amorphous polyester resin (B3) was pulverized and mixed with 638 g of sodium lauryl sulfate solution with a concentration of 0.26% by mass, which was previously produced. The mixture was dispersed by an ultrasonic homogenizer "US-150T" (manufactured by NISSEI Corporation) at V-LEVEL, 300 μA over 60 minutes under stirring, to prepare a dispersion of amorphous polyester resin microparticles (B3) having amorphous polyester resin microparticles having a volume-based median diameter of 140 nm dispersed therein.

[Preparation of Dispersion of Amorphous Polyester Resin Microparticles (B4)]

(1) Production of Amorphous Polyester Resin (B4)

To a four-necked flask equipped with an inlet for nitrogen, a dehydration tube, a stirrer, and a thermocouple, 100 g of bisphenol A ethylene oxide 2 mol adduct (BPA-EO), 189 g of bisphenol A propylene oxide 2 mol adduct (BPA-PO), 51 g of terephthalic acid (TPA), 61 g of fumaric acid (FA), 25 g of sebacic acid, and 2 g of an esterification catalyst (tin octylate) were placed and subjected to polycondensation reaction for 8 hours at 230° C. By further performing the reaction for 1 hour at 8 kPa and cooling to 160° C., a mixture containing 6 g of acrylic acid (AA), 70 g of styrene (ST), 31 g of n-butyl acrylate (BA), and 20 g of a polymerization initiator (di-t-butyl peroxide) was added over 1 hour by using a dropping funnel. After the dropwise addition, the addition polymerization reaction was continued for 1 hour while maintaining 160° C. Then, the temperature was raised to 200° C. and it was maintained for 1 hour at 10 kPa. Thereafter, by removing the unreacted acrylic acid, styrene, and butyl acrylate, an amorphous polyester resin (B4) as a composite resin including a vinyl polymerization segment and a polyester polymerization segment that are bound to each other was obtained.

(2) Preparation of Dispersion of Amorphous Polyester Resin Microparticles (B4)

By using "Randel Mill Type: RM" (manufactured by TOKUJU CORPORATION), 100 g of the amorphous polyester resin (B4) was pulverized and mixed with 638 g of sodium lauryl sulfate solution with a concentration of 0.26% by mass, which was previously produced. The mixture was dispersed by an ultrasonic homogenizer "US-150T" (manufactured by NISSEI Corporation) at V-LEVEL, 300 μA over 60 minutes under stirring, to prepare a dispersion of amorphous polyester resin microparticles (B4) having amorphous polyester resin microparticles having a volume-based median diameter of 105 nm dispersed therein.

[Preparation of Dispersion of Amorphous Polyester Resin Microparticles (B5)]

(1) Production of Amorphous Polyester Resin (B5)

To a four-necked flask equipped with an inlet for nitrogen, a dehydration tube, a stirrer, and a thermocouple, 100 g of bisphenol A ethylene oxide 2 mol adduct (BPA-EO), 189 g of bisphenol A propylene oxide 2 mol adduct (BPA-PO), 86 g of terephthalic acid (TPA), 51 g of fumaric acid (FA), and 2 g of an esterification catalyst (tin octylate) were placed and subjected to polycondensation reaction for 8 hours at 230° C. By further performing the reaction for 1 hour at 8 kPa, an amorphous polyester resin (B5) was obtained.

(2) Preparation of Dispersion of Amorphous Polyester Resin Microparticles (B5)

By using "Randel Mill Type: RM" (manufactured by TOKUJU CORPORATION), 100 g of the amorphous polyester resin (B5) was pulverized and mixed with 638 g of sodium lauryl sulfate solution with a concentration of 0.26% by mass, which was previously produced. The mixture was dispersed by an ultrasonic homogenizer "US-150T" (manufactured by NISSEI Corporation) at V-LEVEL, 300 μA over 60 minutes under stirring, to prepare a dispersion of amorphous polyester resin microparticles (B5) having amorphous polyester resin microparticles having a volume-based median diameter of 170 nm dispersed therein.

[Preparation of Dispersion of Microparticles of Releasing Agent (W)]

450 g of wax (behenyl behenate) as a releasing agent, 50 g of sodium lauryl sulfate, and 3500 g of ion exchange water were heated to 60° C. and fully dispersed by using ULTRA-TURRAX T50 (manufactured by IKA). Then, by dispersion treatment using a pressure-extrusion type Gaulin homogenizer, a dispersion of microparticles of releasing agent (W) having microparticles of releasing agent having a volume-based median diameter of 180 nm dispersed therein was prepared.

[Preparation of Dispersion of Colorant Microparticles (C)]

In 1600 g of ion exchange water, 90 g of sodium dodecyl sulfate was dissolved under stirring. While stirring the solution, 420 g of carbon black "MOGUL L" (manufactured by Cabot Corporation) was gradually added thereto. Subsequently, the mixture was subjected to dispersion treatment by using a stirring device "CLEAMIX" (manufactured by M Technique Co., Ltd.), to prepare a dispersion of colorant microparticles (C) having colorant microparticles dispersed therein. The particle diameter of the dispersion was measured by using a micro-track particle size distribution analyzer "UPA-150" (manufactured by NIKKISO CO., LTD.), and as a result, it was found to be 117 nm.

Manufacture of Toner [1]

Example 1

Aggregation and Fusion Step

The dispersion of amorphous resin microparticles (A1) in an amount of 280 g in terms of solid content, the dispersion of amorphous polyester resin microparticles (B1) in an amount of 60 g in terms of solid content, and 2000 g of ion exchange water were added to a reaction vessel equipped with a stirrer, and a temperature sensor, and a condenser, and then the pH was adjusted to 10 by adding an aqueous 5 mol/liter sodium hydroxide solution.

Subsequently, the dispersion of colorant microparticles (C) was added in an amount of 45 g in terms of solid content, and an aqueous solution containing 60 g of magnesium chloride dissolved in 60 g of ion exchange water was further added at 30° C. over 10 minutes under stirring. After keeping for 3 minutes, the temperature started to increase, and the system was heated over 60 minutes to 85° C. and the particle growth reaction was continued while being maintained at 85° C. In such state, a particle diameter of associated particles was measured by using "Multisizer 3" (manufactured by Beckman Coulter, Inc.), and when the volume-based median diameter ($D_{50}$% diameter) reached 6.0 μm, an aqueous solution containing 190 g of sodium chloride dissolved in 760 g of ion exchange water was added thereto, to terminate the particle growth reaction. The temperature was further increased, and by stirring under heating at 90° C., particle fusion was allowed to occur. Then, when the average circularity reached 0.945 as determined by using a flow type particle analyzer "FPIA-2100" (manufactured by Sysmex Co.) (HPF detection number of 4000), it was cooled to 30° C. to obtain a dispersion of toner particles [1]. The volume average particle diameter ($D_{50}$% diameter) of the toner particles [1] was found to be 5.9 μm.

(Washing and Drying Step)

The dispersion of the toner particles [1] produced by the aggregation and fusion step was subjected to solid/liquid separation by using a centrifuge, to remove coarse particles or fine particles. Accordingly, a wet cake of the toner particles was formed. The wet cake was washed with ion exchange water at 35° C. using a centrifuge until the electric conductivity of filtrate became 5 μS/cm. After that, it was transferred to "Flash Jet Dryer" (manufactured by SEISHIN ENTERPRISE Co., Ltd.) and dried until the moisture content reached 0.5% by mass.

(Step for Adding External Additive)

To the toner particles [1] obtained after drying treatment, 2.5% by mass of hydrophobic silica (number average primary particle diameter=120 nm), 1.0% by mass of hydrophobic titania (number average primary particle diameter=12 nm), and 0.6% by mass of hydrophobic titania (number average primary particle diameter=20 nm) were added, and followed by mixing with a Henschel mixer to manufacture the toner [1].

Manufacture of Toner [2]

Example 2

The toner [2] was prepared in the same manner as the manufacture of the toner [1] except that the dispersion of amorphous polyester resin microparticles (B1) was changed to the dispersion of amorphous polyester resin microparticles (B3).

Manufacture of Toner [3]

Example 3

The toner [3] was prepared in the same manner as the manufacture of the toner [1] except that the dispersion of amorphous polyester resin microparticles (B1) was changed to the dispersion of amorphous polyester resin microparticles (B4).

Manufacture of Toner [4]

Example 4

Aggregation and Fusion Step

The dispersion of amorphous resin microparticles (A2) in an amount of 258 g in terms of solid content, the dispersion of amorphous polyester resin microparticles (B2) in an amount of 35 g in terms of solid content, a dispersion of microparticles of a releasing agent (W) at a sold content of 22 g, and 2000 g of ion exchange water were added to a reaction vessel equipped with a stirrer, and a temperature sensor, and a condenser, and then the pH was adjusted to 10 by adding an aqueous 5 mol/liter sodium hydroxide solution.

Subsequently, the dispersion of colorant microparticles (C) was added in an amount of 45 g in terms of solid content, and an aqueous solution containing 60 g of magnesium chloride dissolved in 60 g of ion exchange water was further added at 30° C. over 10 minutes under stirring. After keeping for 3 minutes, the temperature started to increase, and the system was heated over 60 minutes to 85° C. and the particle growth reaction was continued while being maintained at 85° C. In such state, the particle diameter of associated particles was measured by using "Multisizer 3" (manufactured by Beckman Coulter, Inc.), and when the volume-based median diameter ($D_{50}$% diameter) reached 6.0 μm, an aqueous solution containing 190 g of sodium chloride dissolved in 760 g of ion exchange water was added thereto, to terminate the particle growth reaction. The temperature was further increased, and by stirring under heating at 90° C., particle fusion was allowed to occur. Then, when the average circularity reached 0.945 as determined by using a flow type particle analyzer "FPIA-2100" (manufactured by Sysmex Co.) (HPF detection number of 4000), it was cooled to 30° C. to obtain a dispersion of the toner particles [4]. The volume average particle diameter ($D_{50}$% diameter) of the toner particles [4] was found to be 5.9 μm.

After that, by performing the same washing and drying step and step for adding external additive as those for manufacturing the toner [1], the toner [4] was manufactured.

Manufacture of Toner [5]

Example 5

The toner [5] was manufactured in the same manner as the manufacture of the toner [4] except that the dispersion of amorphous polyester resin microparticles (B2) was changed to the dispersion of amorphous polyester resin microparticles (B3).

Manufacture of Toner [6]

Example 6

The toner [6] was manufactured in the same manner as the manufacture of the toner [1] except that 280 g (in terms of solid content) of the dispersion of microparticles of amorphous resin (A1) was changed to 315 g (in terms of solid content) of the dispersion of microparticles of amorphous resin (A3) and 60 g (in terms of solid content) of the dispersion of amorphous polyester resin microparticles (B1) was changed to 25 g (in terms of solid content) of the dispersion of amorphous polyester resin microparticles (B2).

Manufacture of Toner [7]

Comparative Example 1

The toner [7] was manufactured in the same manner as the manufacture of the toner [4] except that the dispersion of microparticles of amorphous resin (A2) was changed to the dispersion of microparticles of amorphous resin (A4) and the dispersion of amorphous polyester resin microparticles (B2) was changed to the dispersion of amorphous polyester resin microparticles (B5).

Manufacture of Toner [8]

Comparative Example 2

The toner [8] was manufactured in the same manner as the manufacture of the toner [4] except that the dispersion of microparticles of amorphous resin (A2) was changed to the dispersion of microparticles of amorphous resin (A5) and the dispersion of amorphous polyester resin microparticles (B2) was changed to the dispersion of amorphous polyester resin microparticles (B1).

<Observation of Domain-Matrix Structure>

The cross-sectional structure of the toner particles was determined for each of the toners [1] to [8] obtained from above.

As an apparatus for evaluation, a scanning transmission electron microscope "JSM-7401F" (manufactured by JEOL Ltd.) was used, and a toner segment with a thickness of 100 to 200 nm which was stained with $RuO_4$ was observed at an acceleration speed of 30 kV and a magnification ratio: ×10000 (bright field image).

The toner segment stained with $RuO_4$ was produced as described below.

Toner particles were dispersed in a photocurable resin "D-800" (manufactured by JEOL Ltd.) followed by photocuring for forming a block. Subsequently, by using a microtome equipped with diamond teeth, a foil-like sample with a thickness of 100 to 200 nm was cut out from the block. It was then applied on a grid with a supporting film which is used for a scanning transmission electron microscope.

A filter paper was applied on a 5 cmϕ plastic petri dish and the grid added with the segment was applied on the filter paper such that the segment side faced upward. Next, two or three drops of the 0.5% $RuO_4$ staining solution were added dropwise on two areas in the petri dish and covered with a lid. Ten minutes later, the cover of a petri dish was removed, and the dish was kept until moisture of the staining solution disappeared. It was then used for the evaluation.

(Method for Identification)

The toner components in the toner particles were identified according to the following criteria.

Dark tone is observed: Amorphous resin (A)

Bright tone is observed: Amorphous polyester resin (B)

Bright tone is observed and also interface is observed with dark tone: Releasing agent <Calculation of Number Average Domain Diameter and Area Ratio>

As an apparatus for evaluation, a scanning transmission electron microscope (which is the same as the observation of a domain-matrix structure) and an image processing and analyzing device "LUZEX (registered trademark) AP" (manufactured by Nireco Corporation) were used.

The method for obtaining a toner particle image for measurement was the same as in the "Observation of domain-matrix structure". The results are shown in Table 1.

(Method for Measurement)

With regard to the toner particle image for measurement, 25 or more visual fields of the toner particles in which the cross section diameter of a toner particle equals to the volume average particle diameter ($D_{50}$% diameter) of the toner particle ±10% are selected and used for the measurements. Among the 25 or more visual fields of the toner particle image, 200 or more domain phases which include the amorphous polyester resin (B) with a domain diameter of 100 nm or more are randomly selected and used for measurement of the domain diameter.

The number average domain diameter is calculated as an average value of Feret diameters in a horizontal direction. The domain area is obtained by measuring the actual area of a domain phase with a diameter of 100 nm or more. The Feret diameter in the horizontal direction described herein represents the side length of a circumscribed rectangle according to binarization of an image, in which the side indicates a line parallel to X axis.

TABLE 1

| | Amorphous resin (A) | | | Amorphous polyester resin (B) | | | | Mixing ratio (A:B) | Number average domain | Area |
|---|---|---|---|---|---|---|---|---|---|---|
| Toner No. | No. | Resin type | Monomer constitution | No. | Resin type | Saturated aliphatic dicarboxylic acid with 6 or more carbon atoms | Monomer constitution | (mass ratio) | diameter (nm) | ratio (%) |
| [1] | (A1) | Styrene-acrylic resin | ST/BA/MAA | (B1) | Amorphous polyester resin | Adipic acid | BPA-EO/BPA-PO/TPA/FA/Adipic acid | 81:19 | 165 | 4.6 |
| [2] | (A1) | Styrene-acrylic resin | ST/BA/MAA | (B3) | Composite resin | Adipic acid | ST/BA/AA/BPA-EO/BPA-PO/TPA/FA/Adipic acid | 81:19 | 155 | 0.0 |

TABLE 1-continued

| Toner No. | Amorphous resin (A) No. | Resin type | Monomer constitution | Amorphous polyester resin (B) No. | Resin type | Saturated aliphatic dicarboxylic acid with 6 or more carbon atoms | Monomer constitution | Mixing ratio (A:B) (mass ratio) | Number average domain diameter (nm) | Area ratio (%) |
|---|---|---|---|---|---|---|---|---|---|---|
| [3] | (A1) | Styrene-acrylic resin | ST/BA/MAA | (B4) | Composite resin | Sebacic acid | ST/BA/AA/BPA-EO/BPA-PO/TPA/FA/Adipic acid | 81:19 | 121 | 1.7 |
| [4] | (A2) | Amorphous polyester resin | BPA-EO/BPA-PO/TPA/FA | (B2) | Amorphous polyester resin | Sebacic acid | BPA-EO/BPA-PO/TPA/FA/Sebacic acid | 89:11 | 137 | 9.1 |
| [5] | (A2) | Amorphous polyester resin | BPA-EO/BPA-PO/TPA/FA | (B3) | Composite resin | Adipic acid | ST/BA/AA/BPA-EO/BPA-PO/TPA/FA/Adipic acid | 89:11 | 175 | 8.2 |
| [6] | (A3) | Styrene-acrylic resin | ST/LA(C: 12)/MAA | (B2) | Amorphous polyester resin | Sebacic acid | BPA-EO/BPA-PO/TPA/FA/Sebacic acid | 92:8 | 116 | 6.9 |
| [7] | (A4) | Amorphous polyester resin | BPA-EO/BPA-PO/TPA/FA/Sebacic acid | (B5) | Amorphous polyester resin | — | BPA-EO/BPA-PO/TPA/FA | 89:11 | 213 | 10.5 |
| [8] | (A5) | Amorphous polyester resin | BPA-EO/BPA-PO/TPA/FA/Adipic acid | (B1) | Amorphous polyester resin | Adipic acid | BPA-EO/BPA-PO/TPA/FA/Adipic acid | 81:19 | — | — |

※ "ST": styrene,
"BA": n-butyl acrylate,
"MAA": methacrylic acid,
"LA": n-lauryl acrylate,
"AA": acrylic acid,
"BPA-EO": bisphenol A ethylene oxide 2 mol adduct,
"BPA-PO": bisphenol A propylene oxide 2 mol adduct,
"TPA": terephthalic acid,
"FA": fumaric acid <<Production of Developer[1]>>

(1) Production of Carrier

Into a high-speed mixer equipped with a stirring blade, 100 pasts by mass of a ferrite core and 5 parts by mass of copolymer resin particles of cyclohexyl methacrylate/methyl methacrylate (copolymerization ratio of 5/5) were placed and mixed with stirring at 120° C. over 30 minutes, to forma resin coating layer on the surface of the ferrite core by action of mechanical impact force, whereby the carrier [1] with a volume-based median diameter of 50 μm was obtained.

(2) Mixing Toner with Carrier

The carrier [1] was added to the toner [1] such that the toner concentration was 6% by mass, and the mixture was placed into a micro type V-shaped mixer (TSUTSUI SCIENTIFIC INSTRUMENTS CO., Ltd.) and mixed at a rotation rate of 45 rpm over 30 minutes, to produce the developer [1].

<<Production of Developers [2] to [8]>>

The developers [2] to [8] were produced in the same manner as the developer [1] except that the toner [1] was changed to each of the toners [2] to [8].

<Evaluation>

(1) Low-Temperature Fixability

The developers [1] to [8] were respectively loaded into a developing device of a commercially available full-color copying machine "bizhub PRO C6500" (manufactured by Konica Minolta, Inc.) and evaluated. The full-color copying machine was modified so that the fixing temperature, toner adhesion amount and system speed could be freely set.

When using, as paper for evaluation, "NPi high quality paper (128 g/m$^2$)" (manufactured by Nippon Paper Industries Co., Ltd.) and fixing a solid image with a toner adhesion amount of 11.3 g/m$^2$ at a fixing speed of 300 mm/sec by setting an upper fixing belt temperature to 150 to 200° C. and a lower fixing roller temperature to be lower than the upper fixing belt by 20° C., and changing the upper fixing belt temperature at an interval of 5° C., evaluation was made with respect to the fixing lower limit temperature in which no cold offset occurred. The lower limit temperature indicates the better fixability. Those showing the lower limit temperature of 160° C. or lower are graded as "Good." The results are shown in Table 2.

(2) Fixability on Uneven Paper (High-Temperature Off-Set Resistance)

The developers [1] to [8] were respectively loaded into a developing device of a commercially available full-color copying machine "bizhub PRO C6500" (manufactured by Konica Minolta, Inc.) and evaluated. The full-color copying machine was modified so that the fixing temperature, toner adhesion amount and system speed could be freely set.

The surface temperature of a heat roller for fixing was set at 180° C., and a solid image was formed on a rough paper "New Komon" (manufactured by Nisshinbo Paper Products Inc.) such that the toner adhesion amount was 4.0 g/m$^2$. Then, the fixed image was rubbed with a rough paper "KIMWIPES S-200" (manufactured by NIPPON PAPER CRECIA Co., LTD.) which was applied with a pressing stone having a load of 11.7 N. Then, the contamination on the rough paper side was evaluated according to the following evaluation criteria. The results are shown in Table 2.

—Evaluation Criteria—

A: No contamination

B: Almost no contamination

C: Slight amount of contamination (no problem in practical use)

D: Contamination (problem in practice use)

(3) Image Density

The developers [1] to [8] were respectively loaded into a developing device of a commercially available full-color copying machine "bizhub PRO C6500" (manufactured by Konica Minolta, Inc.) and evaluated. The full-color copying machine was modified so that the fixing temperature, toner adhesion amount and system speed could be freely set.

A solid image was formed on a regular paper "J paper (64 g/m$^2$)" (manufactured by Konica Minolta, Inc.) such that the toner adhesion amount was 4.0 g/m$^2$. Meanwhile, the fixing rate was set at 300 mm/sec, the upper fixing belt was set at 200° C. and the lower fixing roller was set at a temperature which is lower than the upper belt by 20° C. The image density of the obtained solid image was measured by using a reflection densitometer "RD-918" (manufactured by Macbeth Co., Ltd.). When the reflection density is 1.40 or more, it is graded as "Good." The results are shown in Table 2.

(4) Homogeneity in Image Density

The developers [1] to [8] were respectively loaded into a developing device of a commercially available full-color copying machine "bizhub PRO C6500" (manufactured by Konica Minolta, Inc.) and evaluated. The full-color copying machine was modified so that the fixing temperature, toner adhesion amount and system speed could be freely set.

After an adjustment was made such that the toner adhesion amount was 4.0 g/m$^2$ in a solid part on a regular paper "J paper (64 g/m$^2$)" (manufactured by Konica Minolta, Inc.), a half tone image with an image density of 60% was printed out under a high temperature and high humidity condition (temperature of 30° C. and humidity of 80% RH). Meanwhile, the fixing rate was set at 300 mm/sec, the upper fixing belt was set at 200° C. and the lower fixing roller was set at a temperature which is lower than the upper belt by 20° C. The image density of the obtained half tone image was measured at 5 spots by using a reflection densitometer "RD-918" (manufactured by Macbeth Co., Ltd.) and a difference in reflection density of the half tone image (a difference between the maximum value and the minimum value) was obtained. When the difference in reflection density is less than 0.1, it is graded as "Good." The results are shown in Table 2.

TABLE 2

| | | Evaluation | | | |
|---|---|---|---|---|---|
| | Toner No. | Low-temperature fixability (° C.) | Off-set resistance | Image density | Homogeneity in image density |
| Example 1 | [1] | 155 | B | 1.58 | 0.02 |
| Example 2 | [2] | 140 | A | 1.68 | 0.01 |
| Example 3 | [3] | 145 | A | 1.62 | 0.01 |
| Example 4 | [4] | 160 | C | 1.55 | 0.07 |
| Example 5 | [5] | 145 | C | 1.52 | 0.08 |
| Example 6 | [6] | 155 | B | 1.44 | 0.08 |
| Comparative Example 1 | [7] | 145 | D | 1.41 | 0.13 |
| Comparative Example 2 | [8] | 165 | D | 1.31 | 0.16 |

What is claimed is:

1. A toner for electrostatic image development comprising toner particles containing a binder resin which contains an amorphous resin (A) and an amorphous polyester resin (B) that is different from the amorphous resin (A) and a colorant, wherein said toner particles have a domain-matrix structure having the amorphous polyester resin (B) as a domain phase dispersed in a matrix phase comprising the amorphous resin (A), wherein in a cross-sectional observation image of the toner particles, the number average domain diameter of the domain phase of the amorphous polyester resin (B) having a domain diameter of 100 nm or more is 100 to 200 nm and an area ratio of the domain phase having a domain diameter of 500 nm or more relative to the total area of the domain phase is 0 to 10%, and wherein a domain phase C including the colorant is further dispersed in the matrix phase comprising the amorphous resin (A), and the number average domain diameter of the domain phase C including the colorant is 10 to 300 nm.

2. The toner for electrostatic image development according to claim 1, wherein polyvalent carboxylic acid for forming the amorphous polyester resin (B) contains a linear aliphatic saturated dicarboxylic acid with 6 or more carbon atoms, and a monomer for forming the amorphous resin (A) contain no linear aliphatic saturated dicarboxylic acid with 6 or more carbon atoms.

3. The toner for electrostatic image development according to claim 1, wherein the amorphous resin (A) is a vinyl resin.

4. The toner for electrostatic image development according to claim 1, wherein the amorphous polyester resin (B) is obtained by binding a vinyl polymerization segment and a polyester polymerization segment.

5. The toner for electrostatic image development according to claim 1, wherein the number average domain diameter of the domain phase of the amorphous polyester resin (B) having a domain diameter of 100 nm or more is 100 to 150 nm.

6. The toner for electrostatic image development according to claim 1, wherein the area ratio of the domain phase having a domain diameter of 500 nm or more relative to the total area of the domain phase is 0 to 8%.

7. The toner for electrostatic image development according to claim 1, wherein the area ratio of the domain phase having a domain diameter of 500 nm or more relative to the total area of the domain phase is 0 to 5%.

8. The for electrostatic image development according to claim 1, wherein the amorphous resin (A) is a styrene-acrylic resin.

9. The for electrostatic image development according to claim 1, wherein the polyhydric carboxylic acid for forming the amorphous polyester resin (B) includes saturated linear aliphatic dicarboxylic acid with 6 to 12 carbon atoms.

10. The toner for electrostatic image development according to claim 1, wherein the amorphous polyester resin (B) is a composite resin which is obtained by chemical binding between a vinyl polymerization segment and a polyester polymerization segment via a monomer capable of reacting with both the segment, and a content of the vinyl polymerization segment is 5 to 30% by mass.

11. The toner for electrostatic image development according to claim 1, wherein a mixing ratio between the amorphous resin (A) and the amorphous polyester resin (B) is 70:30 to 95:5, in terms of mass ratio.

12. The toner for electrostatic image development according to claim 1, wherein a mixing ratio between the amorphous resin (A) and the amorphous polyester resin (B) is 80:20 to 90:10, in terms of mass ratio.

13. The toner for electrostatic image development according to claim 1, wherein the toner particle further contains a releasing agent, and the content of the releasing agent is 2 to 20% by mass, relative to the binder resin.

14. The toner for electrostatic image development according to claim 13, wherein the releasing agent is dispersed, in the matrix phase of the toner particle, as a domain phase which is different from the amorphous polyester resin (B), and the number average domain diameter of the domain phase including the releasing agent is in the range of 100 nm to 1 μm.

15. The toner for electrostatic image development according to claim 1, wherein a glass transition point of the amorphous resin (A) is 40 to 60° C.

16. The toner for electrostatic image development according to claim 1, wherein a glass transition point of the amorphous polyester resin (B) is 40 to 70° C.

17. The toner for electrostatic, image development according to claim 1, wherein a volume average particle diameter of the toner particle, is not less than 3 μm and not more than 10 μm, and an average circularity of the toner particle is 0.850 to 0.990.

18. The toner for electrostatic image development according to claim 1, wherein a softening point of the toner of the present invention is 90 to 120° C.

19. The for electrostatic image development according to claim 1, wherein the toner is manufactured by an emulsion aggregation method.

20. A toner for electrostatic image development comprising toner particles containing a binder resin which contains an amorphous resin (A) and an amorphous polyester resin that is different from the amorphous resin (A) and a colorant, wherein said toner particles have a domain-matrix structure having the amorphous polyester resin (B) as a domain phase dispersed in a matrix phase comprising the amorphous resin (A), and wherein in a cross-sectional observation image of the toner particles, the number average domain diameter of the domain phase of the amorphous polyester resin (B) having a domain diameter of 100 nm or more is 100 to 150 nm and an area ratio of the domain phase having a domain diameter of 500 nm or more relative to the total area of the domain phase is 0 to 10%.

* * * * *